US010159618B2

(12) United States Patent
Jackson et al.

(10) Patent No.: US 10,159,618 B2
(45) Date of Patent: Dec. 25, 2018

(54) PATIENT POSITIONING SUPPORT STRUCTURE WITH TRUNK TRANSLATOR

(71) Applicant: WARSAW ORTHOPEDIC, INC., Warsaw, IN (US)

(72) Inventors: Roger P. Jackson, Prairie Village, KS (US); Lawrence E. Guerra, Mission, KS (US); Trevor A. Waggoner, Kansas City, KS (US)

(73) Assignee: Warsaw Orthopedic, Inc., Warsaw, IN (US)

( * ) Notice: Subject to any disclaimer, the term of this patent is extended or adjusted under 35 U.S.C. 154(b) by 0 days.

(21) Appl. No.: 15/789,345

(22) Filed: Oct. 20, 2017

(65) Prior Publication Data

US 2018/0036193 A1 Feb. 8, 2018

Related U.S. Application Data

(63) Continuation of application No. 15/341,167, filed on Nov. 2, 2016, now Pat. No. 9,937,094, which is a continuation of application No. 14/862,835, filed on Sep. 23, 2015, now Pat. No. 9,510,987, which is a continuation of application No. 12/803,192, filed on Jun. 21, 2010, now Pat. No. 9,186,291.

(51) Int. Cl.

| | |
|---|---|
| ***A61G 13/04*** | (2006.01) |
| ***A61G 13/12*** | (2006.01) |
| ***A61G 13/08*** | (2006.01) |
| ***A61G 13/00*** | (2006.01) |

(52) U.S. Cl.

CPC ..... *A61G 13/1295* (2013.01); *A61G 13/0054* (2016.11); *A61G 13/04* (2013.01); *A61G 13/08* (2013.01); *A61G 13/122* (2013.01); *A61G 13/1225* (2013.01); *A61G 13/1235* (2013.01); *A61G 2203/42* (2013.01)

(58) Field of Classification Search

CPC ..... A61G 13/04; A61G 13/08
USPC ..... 5/600, 607, 610–613, 617–619, 624
See application file for complete search history.

(56) References Cited

U.S. PATENT DOCUMENTS

| | | | | |
|---|---|---|---|---|
| 3,584,321 A * | 6/1971 | Buchanan | ..... | A61B 6/0442 5/601 |
| 5,131,106 A * | 7/1992 | Jackson | ..... | A61G 13/00 5/607 |
| 2007/0192960 A1* | 8/2007 | Jackson | ..... | A61G 7/001 5/618 |

* cited by examiner

*Primary Examiner* — Fredrick C Conley

(57) ABSTRACT

A patient support structure includes a pair of independently height-adjustable supports, each connected to a patient support. The supports may be independently raised, lowered, rolled or tilted about a longitudinal axis, laterally shifted and angled upwardly or downwardly. Position sensors are provided to sense all of the foregoing movements. The sensors communicate data to a computer for coordinated adjustment and maintenance of the inboard ends of the patient supports in an approximated position during such movements. A longitudinal translator provides for compensation in the length of the structure when the supports are angled upwardly or downwardly. A patient trunk translator provides coordinated translational movement of the patient's upper body along the respective patient support in a caudad or cephalad direction as the patient supports are angled upwardly or downwardly for maintaining proper spinal biomechanics and avoiding undue spinal traction or compression.

21 Claims, 17 Drawing Sheets

PATIENT POSITIONING SUPPORT STRUCTURE WITH TRUNK TRANSLATOR

CROSS-REFERENCE TO RELATED APPLICATION

This application is a continuation of U.S. application Ser. No. 15/341,167, filed Nov. 2, 2016, and entitled, "Patient Positioning Support Structure with Trunk Translator," which is a continuation of U.S. application Ser. No. 14/862,835, filed Sep. 23, 2015, now U.S. Pat. No. 9,510,987, which is a continuation of U.S. application Ser. No. 12/803,192, filed Jun. 21, 2010, now U.S. Pat. No. 9,186,291. The entire contents of all of the foregoing applications and patents are fully incorporated herein by reference.

BACKGROUND OF THE INVENTION

The present disclosure is broadly concerned with structure for use in supporting and maintaining a patient in a desired position during examination and treatment, including medical procedures such as imaging, surgery and the like. More particularly, it is concerned with structure having patient support modules that can be independently adjusted to allow a surgeon to selectively position the patient for convenient access to the surgical field and provide for manipulation of the patient during surgery including the tilting, lateral shifting, pivoting, angulation or bending of a trunk and/or a joint of a patient while in a generally supine, prone or lateral position. It is also concerned with structure for adjusting and/or maintaining the spatial relation between the inboard ends of the patient supports and for synchronized translation of the upper body of a patient as the inboard ends of the two patient supports are angled upwardly and downwardly.

Current surgical practice incorporates imaging techniques and technologies throughout the course of patient examination, diagnosis and treatment. For example, minimally invasive surgical techniques, such as percutaneous insertion of spinal implants involve small incisions that are guided by continuous or repeated intra-operative imaging. These images can be processed using computer software programs that product three dimensional images for reference by the surgeon during the course of the procedure. If the patient support surface is not radiolucent or compatible with the imaging technologies, it may be necessary to interrupt the surgery periodically in order to remove the patient to a separate surface for imaging, followed by transfer back to the operating support surface for resumption of the surgical procedure. Such patient transfers for imaging purposes may be avoided by employing radiolucent and other imaging compatible systems. The patient support system should also be constructed to permit unobstructed movement of the imaging equipment and other surgical equipment around, over and under the patient throughout the course of the surgical procedure without contamination of the sterile field.

It is also necessary that the patient support system be constructed to provide optimum access to the surgical field by the surgery team. Some procedures require positioning of portions of the patient's body in different ways at different times during the procedure. Some procedures, for example, spinal surgery, involve access through more than one surgical site or field. Since all of these fields may not be in the same plane or anatomical location, the patient support surfaces should be adjustable and capable of providing support in different planes for different parts of the patient's body as well as different positions or alignments for a given part of the body. Preferably, the support surface should be adjustable to provide support in separate planes and in different alignments for the head and upper trunk portion of the patient's body, the lower trunk and pelvic portion of the body as well as each of the limbs independently.

Certain types of surgery, such as orthopedic surgery, may require that the patient or a part of the, patient be repositioned during the procedure while in some cases maintaining the sterile field. Where surgery is directed toward motion preservation procedures, such as by installation of artificial joints, spinal ligaments and total disc prostheses, for example, the surgeon must be able to manipulate certain joints while supporting selected portions of the patient's body during surgery in order to facilitate the procedure. It is also desirable to be able to test the range of motion of the surgically repaired or stabilized joint and to observe the gliding movement of the reconstructed articulating prosthetic surfaces or the tension and flexibility of artificial ligaments, spacers and other types of dynamic stabilizers before the wound is closed. Such manipulation can be used, for example, to verify the correct positioning and function of an implanted prosthetic disc, spinal dynamic longitudinal connecting member, interspinous spacer or joint replacement during a surgical procedure. Where manipulation discloses binding, sub-optimal position or even crushing of the adjacent vertebrae, for example, as may occur with osteoporosis, the prosthesis can be removed and the adjacent vertebrae fused while the patient remains anesthetized. Injury which might otherwise have resulted from a "trial" use of the implant post-operatively will be avoided, along with the need for a second round of anesthesia and surgery to remove the implant or prosthesis and perform the revision, fusion or corrective surgery.

There is also a need for a patient support surface that can be rotated, articulated and angulated so that the patient can be moved from a prone to a supine position or from a prone to a 90.degree. position and whereby intra-operative extension and flexion of at least a portion of the spinal column can be achieved. The patient support surface must also be capable of easy, selective adjustment without necessitating removal of the patient or causing substantial interruption of the procedure.

For certain types of surgical procedures, for example spinal surgeries, it may be desirable to position the patient for sequential anterior and posterior procedures. The patient support surface should also be capable or rotation about an axis in order to provide correct positioning of the patient and optimum accessibility for the surgeon as well as imaging equipment during such sequential procedures.

Orthopedic procedures may also require the use of traction equipment such a cables, tongs, pulleys and weights. The patient support system must include structure for anchoring such equipment and it must provide adequate support to withstand unequal forces generated by traction against such equipment.

Articulated robotic arms are increasingly employed to perform surgical techniques. These units are generally designed to move short distances and to perform very precise work. Reliance on the patient support structure to perform any necessary gross movement of the patient can be beneficial, especially if the movements are synchronized or coordinated. Such units require a surgical support surface capable of smoothly performing the multi-directional movements which would otherwise be performed by trained medical personnel. There is thus a need in this application as well for integration between the robotics technology and the patient positioning technology.

While conventional operating tables generally include structure that permits tilting or rotation of a patient support surface about a longitudinal axis, previous surgical support devices have attempted to address the need for access by providing a cantilevered patient support surface on one end. Such designs typically employ either a massive base to counterbalance the extended support member or a large overhead frame structure to provide support from above. The enlarged base members associated with such cantilever designs are problematic in that they can and do obstruct the movement of C-arm and O-arm mobile fluoroscopic imaging devices and other equipment. Surgical tables with overhead frame structures are bulky and may require the use of dedicated operating rooms, since in some cases they cannot be moved easily out of the way. Neither of these designs is easily portable or storable.

Articulated operating tables that employ cantilevered support surfaces capable of upward and downward angulation require structure to compensate for variations in the spatial relation of the inboard ends of the supports as they are raised and lowered to an angled position either above or below a horizontal plane. As the inboard ends of the supports are raised or lowered, they form a triangle, with the horizontal plane of the table forming the base of the triangle. Unless the base is commensurately shortened, a gap will develop between the inboard ends of the supports.

Such up and down angulation of the patient supports also causes a corresponding flexion or extension, respectively, of the lumbar spine of a prone patient positioned on the supports. Raising the inboard ends of the patient supports generally causes flexion of the lumbar spine of a prone patient with decreased lordosis and a coupled or corresponding posterior rotation of the pelvis around the hips. When the top of the pelvis rotates in a posterior direction, it pulls the lumbar spine and wants to move or translate the thoracic spine in a caudal direction, toward the patient's feet. If the patient's trunk, entire upper body and head and neck are not free to translate or move along the support surface in a corresponding caudal direction along with the posterior pelvic rotation, excessive traction along the entire spine can occur, but especially in the lumbar region. Conversely, lowering the inboard ends of the patient supports with downward angulation causes extension of the lumbar spine of a prone patient with increased lordosis and coupled anterior pelvic rotation around the hips. When the top of the pelvis rotates in an anterior direction, it pushes and wants to translate the thoracic spine in a cephalad direction, toward the patient's head. If the patient's trunk and upper body are not free to translate or move along the longitudinal axis of the support surface in a corresponding cephalad direction during lumbar extension with anterior pelvic rotation, unwanted compression of the spine can result, especially in the lumbar region.

Thus, there remains a need for a patient support system that provides easy access for personnel and equipment, that can be positioned and repositioned easily and quickly in multiple planes without the use of massive counterbalancing support structure, and that does not require use of a dedicated operating room. There is also a need for such a system that permits upward and downward angulation of the inboard ends of the supports, either alone or in combination with rotation or roll about the longitudinal axis, all while maintaining the ends in a preselected spatial relation, and at the same time providing for coordinated translation of the patient's upper body in a corresponding caudad or cephalad direction to thereby avoid excessive compression or traction on the spine.

SUMMARY OF THE INVENTION

The present disclosure is directed to a patient positioning support structure that permits adjustable positioning, repositioning and selectively lockable support of a patient's head and upper body, lower body and limbs in up to a plurality of individual planes while permitting rolling or tilting, lateral shifting, angulation or bending and other manipulations as well as full and free access to the patient by medical personnel and equipment. The system of the invention includes at least one support end or column that is height adjustable. The illustrated embodiments include a pair of opposed, independently height-adjustable end support columns. The columns may be independent or connected to a base. Longitudinal translation structure is provided enabling adjustment of the distance or separation between the support columns. One support column may be coupled with a wall mount or other stationary support. The support columns are each connected with a respective patient support, and structure is provided for raising, lowering, roll or tilt about a longitudinal axis, lateral shifting and angulation of the respective connected patient support, as well as longitudinal translation structure for adjusting and/or maintaining the distance or separation between the inboard ends of the patient supports during such movements.

The patient supports may each be an open frame or other patient support that may be equipped with support pads, slings or trolleys for holding the patient, or other structures, such as imaging or other tops which provide generally flat surfaces. Each patient support is connected to a respective support column by a respective roll or tilt, articulation or angulation adjustment mechanism for positioning the patient support with respect to its end support as well as with respect to the other patient support. Roll or tilt adjustment mechanisms in cooperation with pivoting and height adjustment mechanisms provide for the lockable positioning of the patient supports in a variety of selected positions and with respect to the support columns, including coordinated rolling or tilting, upward and downward coordinated angulation (Trendelenburg and reverse Trendelenburg configurations), upward and downward breaking angulation, and lateral shifting toward and away from a surgeon.

At least one of the support columns includes structure enabling movement of the support column toward or away from the other support column in order to adjust and/or maintain the distance between the support columns as the patient supports are moved. Lateral movement of the patient supports (toward and away from the surgeon) is provided by a bearing block feature. A trunk translator for supporting a patient on one of the patient supports cooperates with all of the foregoing, in particular the upward and downward breaking angulation adjustment structure, to provide for synchronized translational movement of the upper portion of a patient's body along the length of one of the patient supports in a respective corresponding caudad or cephalad direction for maintaining proper spinal biomechanics and avoiding undue spinal traction or compression.

Sensors are provided to measure all of the vertical, horizontal or lateral shift, angulation, tilt or roll movements and longitudinal translation of the patient support system. The sensors are electronically connected with and transmit data to a computer that calculates and adjusts the movements of the patient trunk translator and the longitudinal translation structure to provide coordinated patient support with proper biomechanics.

Various objects and advantages of this patient support structure will become apparent from the following description taken in conjunction with the accompanying drawings wherein are set forth, by way of illustration and example, certain embodiments of this disclosure.

The drawings constitute a part of this specification, include exemplary embodiments, and illustrate various objects and features thereof.

DETAILED DESCRIPTION

Figure 1:
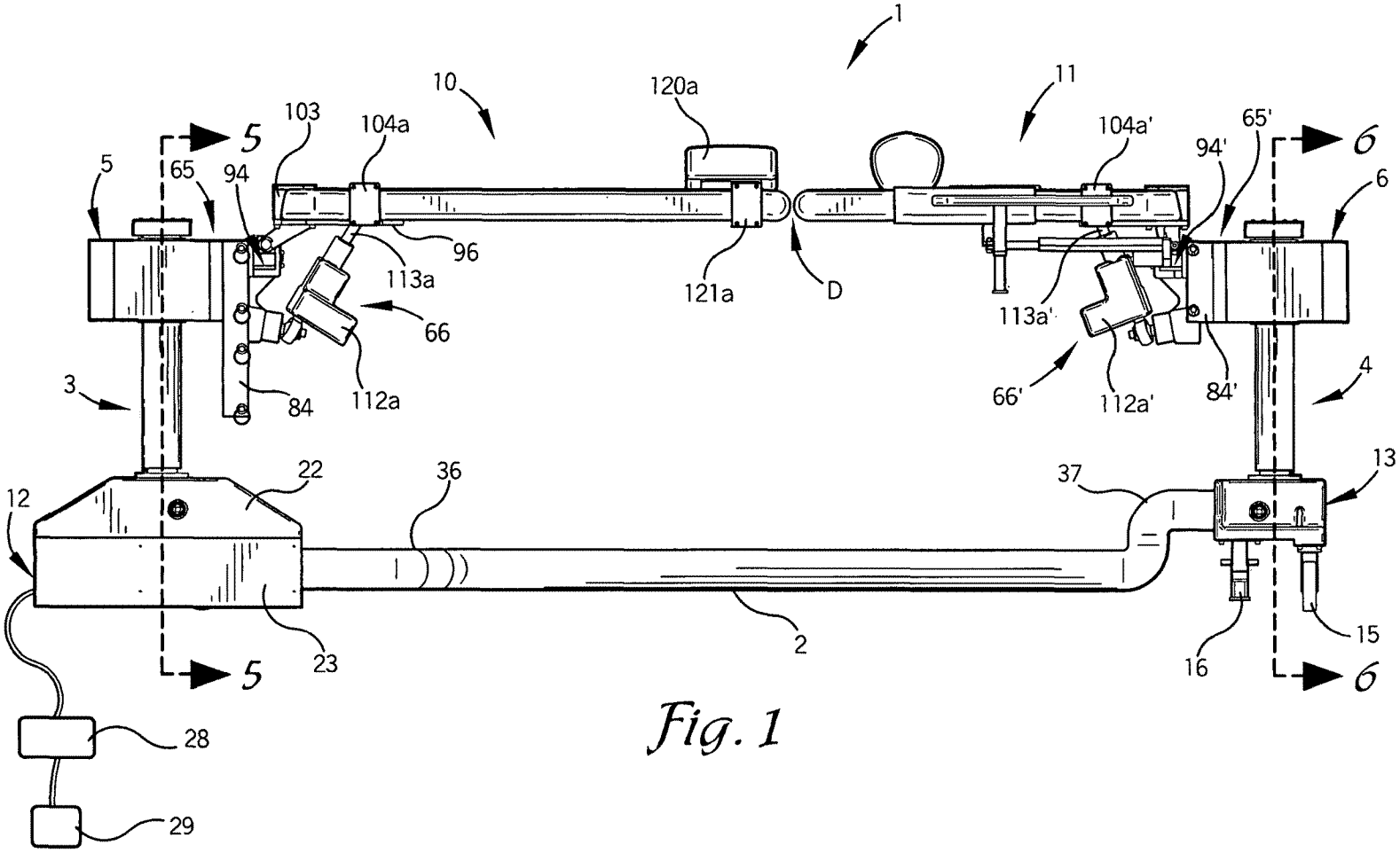
FIG. 1 is a side elevational view of an embodiment of a patient positioning support structure according to the invention.

As required, detailed embodiments of the patient positioning support structure are disclosed herein; however, it is to be understood that the disclosed embodiments are merely exemplary of the apparatus, which may be embodied in various forms. Therefore, specific structural and functional details disclosed herein are not to be interpreted as limiting, but merely as a basis for the claims and as a representative basis for teaching one skilled in the art to variously employ the disclosure in virtually any appropriately detailed structure.

Referring now to the drawings, an embodiment of a patient positioning support structure according to the disclosure is generally designated by the reference numeral 1 and is depicted in FIGS. 1-12. The structure 1 includes first and second upright end support pier or column assemblies 3 and 4 which are illustrated as connected to one another at their bases by an elongate connector rail or rail assembly 2. It is foreseen that the column support assemblies 3 and 4 may be constructed as independent, floor base supports that are not interconnected as shown in the illustrated embodiment. It is also foreseen that in certain embodiments, one or both of the end support assemblies may be replaced by a wall mount or other building support structure connection, or that one or both of their bases may be fixedly connected to the floor structure. The first upright support column assembly 3 is connected to a first support assembly, generally 5, and the second upright support column assembly 4 is connected to a second support assembly 6. The first and second support assemblies 5 and 6 each uphold a respective first or second patient holding or support structure 10 or 11. While cantilevered type patient supports 10 and 11 are depicted, it is foreseen that they could be connected by a removable hinge member.

Figure 9:
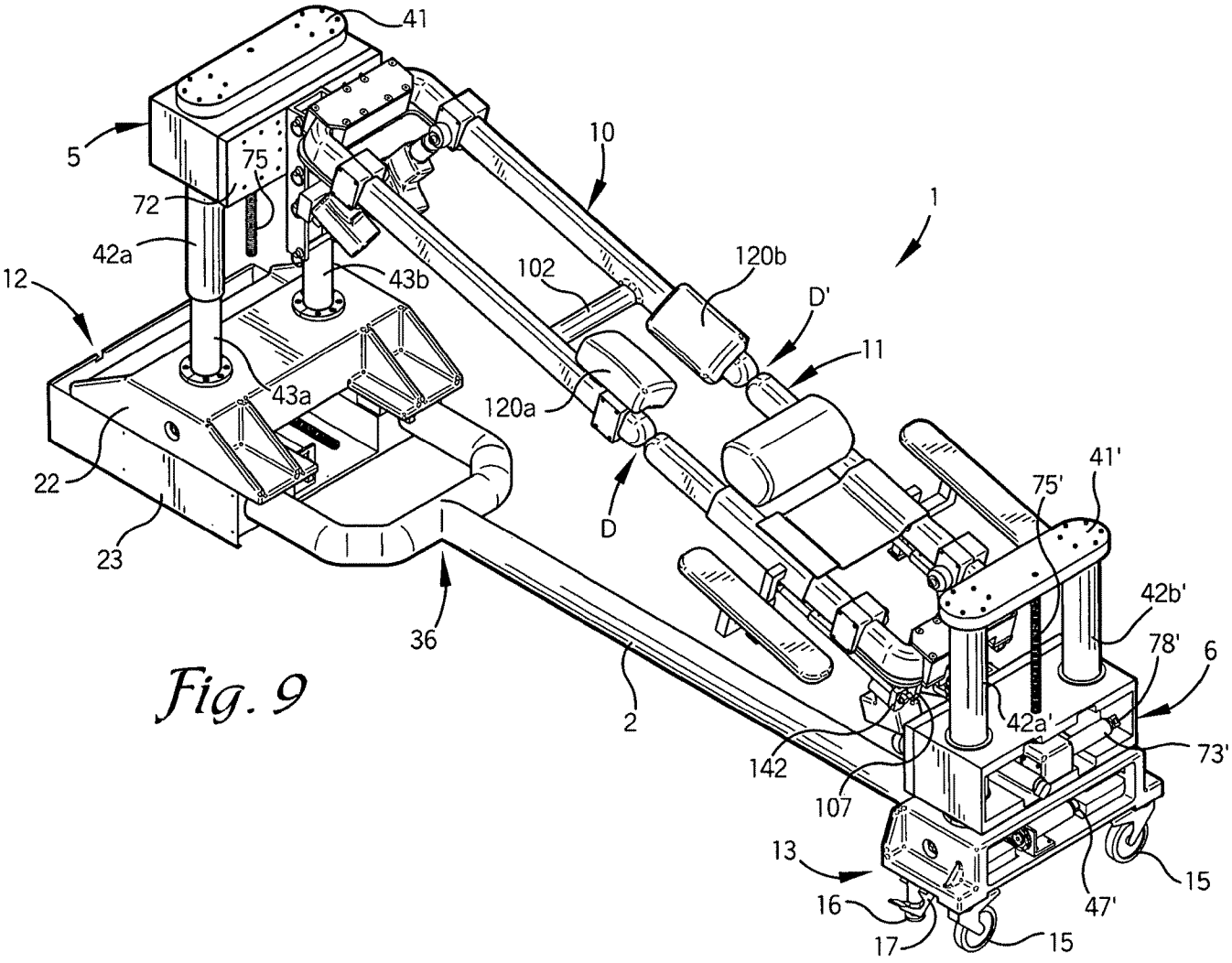
FIG. 9 is a perspective view of the structure of FIG. 1 with the patient supports shown in a planar inclined position, suitable for positioning a patient in Trendelenburg's position.
Figure 10:
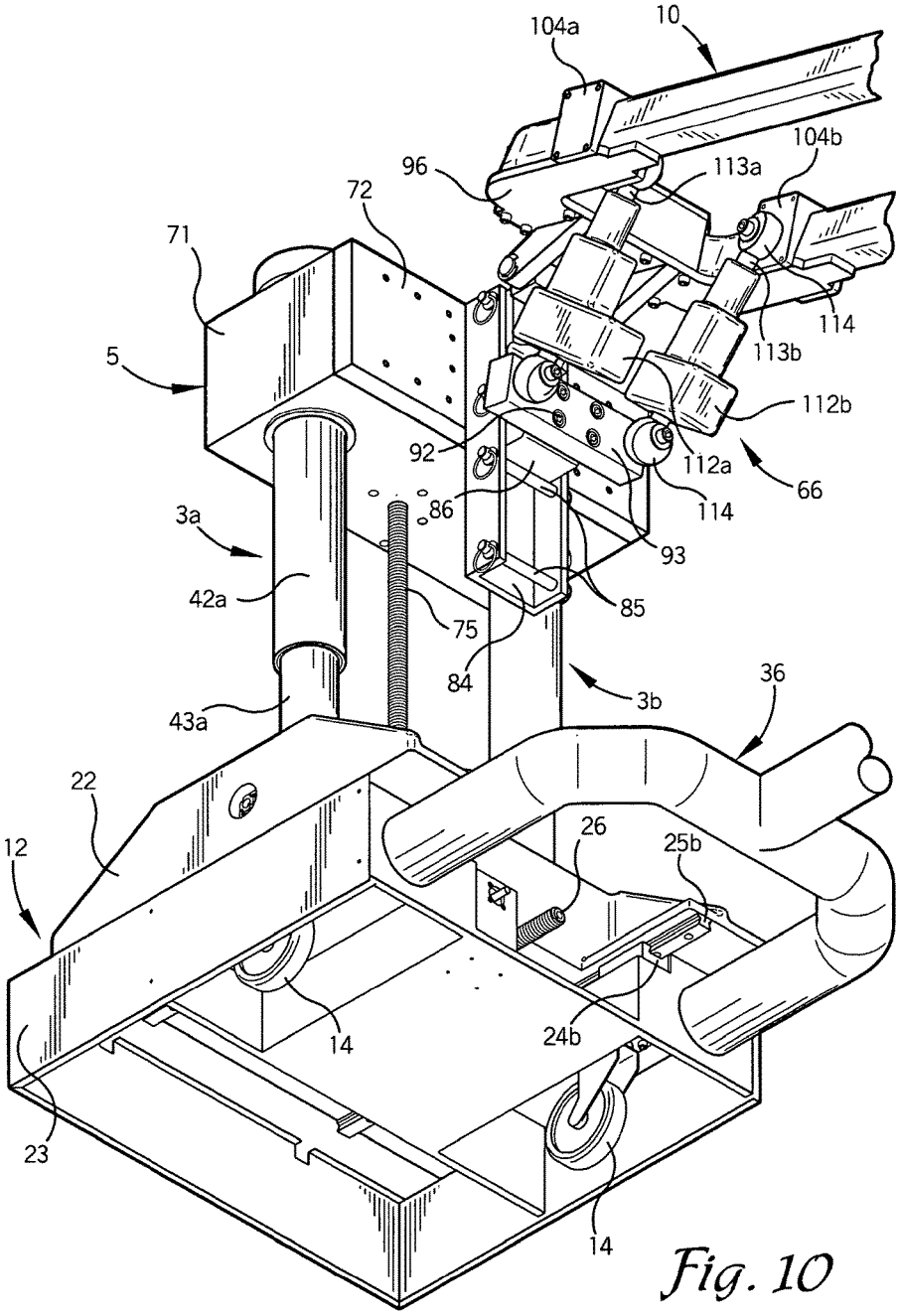
FIG. 10 is an enlarged partial perspective view of a portion of the structure of FIG. 1.

The column assemblies 3 and 4 are supported by respective first and second base members, generally 12 and 13, each of which are depicted as equipped with an optional carriage assembly including a pair of spaced apart casters or wheels, 14 and 15 (FIGS. 9 and 10). The second base portion 13 further includes a set of optional feet 16 with foot-engageable jacks 17 (FIG. 11) for fixing the table 1 to the floor and preventing movement of the wheels 15. It is foreseen that the support column assemblies 3 and 4 may be constructed so that the column assembly 3 has a greater mass than the support column assembly 4 or vice versa in order to accommodate an uneven weight distribution of the human body. Such reduction in size at the foot end of the system 1 may be employed in some embodiments to facilitate the approach of personnel and equipment.

Figure 4:
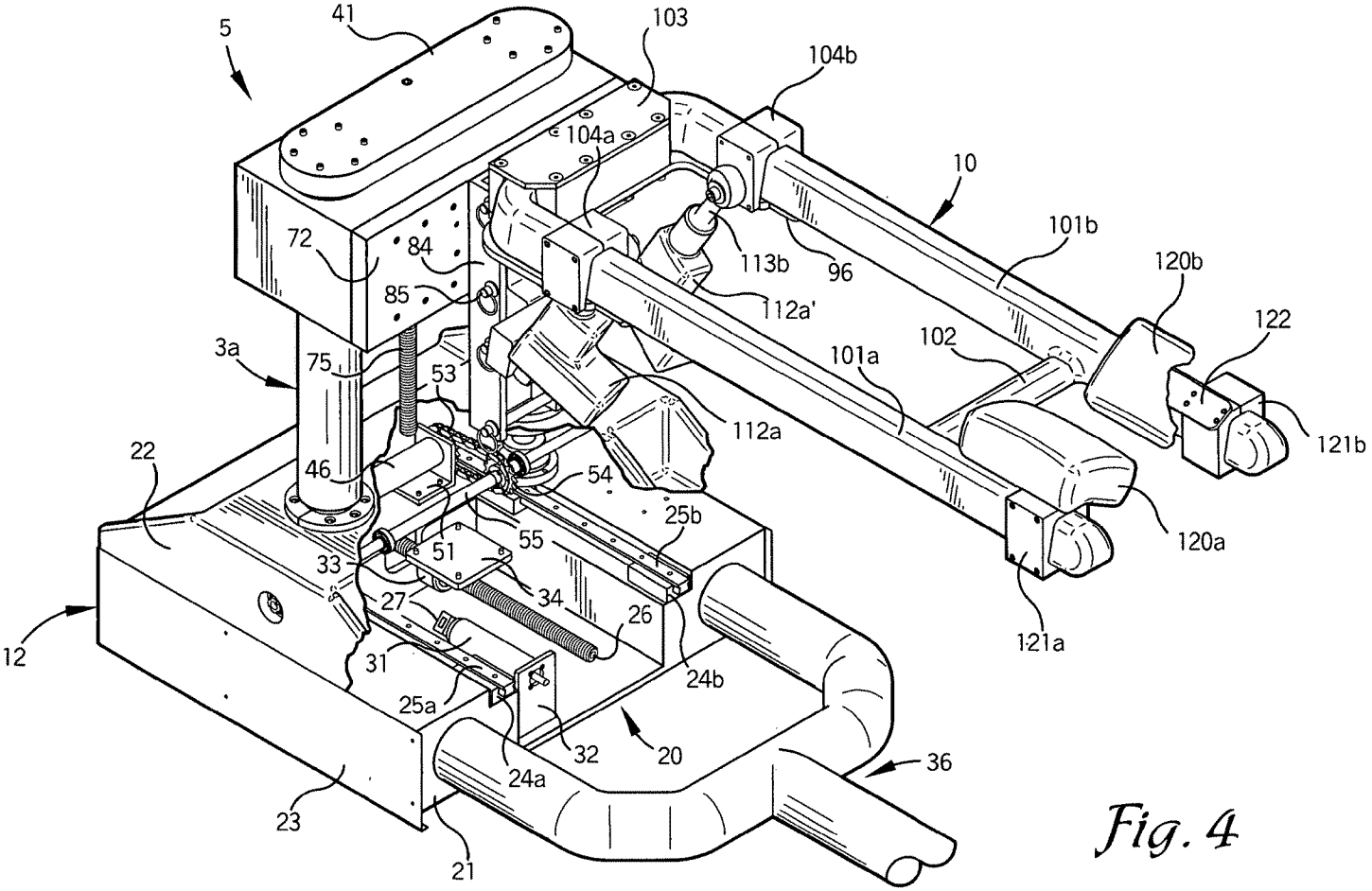
FIG. 4 is an enlarged fragmentary perspective view of the other support column of the patient positioning support structure of FIG. 1, with parts broken away to show details of the base structure.
Figure 7:
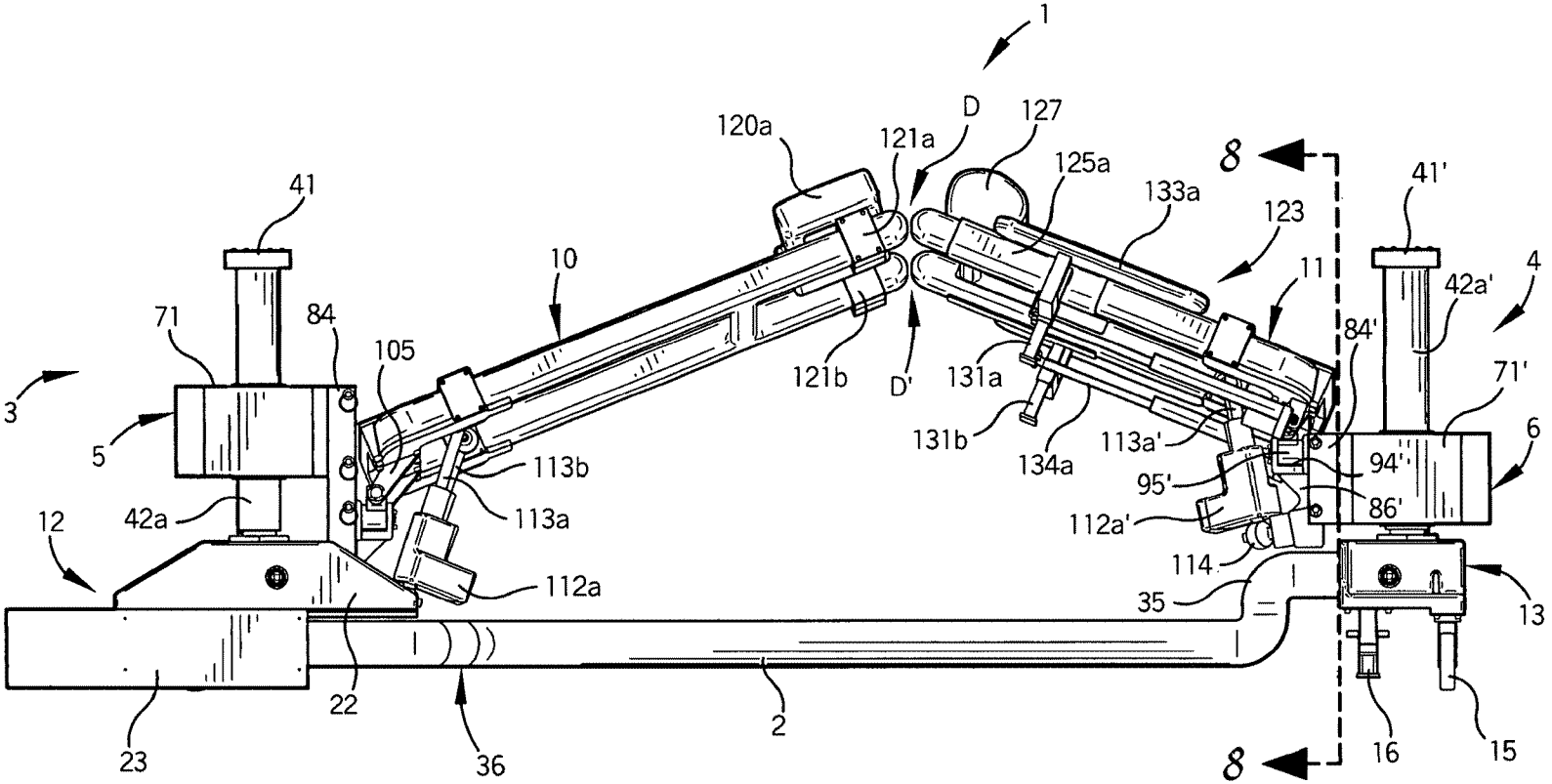
FIG. 7 is a side elevational view of the structure of FIG. 1 shown in a laterally tilted position with the patient supports in an upward breaking position, and with both ends in a lowered position.

The first base member 12, best shown in FIGS. 4 and 7, is normally located at the bottom or foot end of the structure 1 and houses, and is connected to, a longitudinal translation or compensation subassembly 20, including a bearing block or support plate 21 surmounted by a slidable upper housing 22. Removable shrouding 23 spans the openings at the sides and rear of the bearing block 21 to cover the working parts beneath. The shrouding 23 prevents encroachment of feet, dust or small items that might impair sliding back and forth movement of the upper housing on the bearing block 21.

A pair of spaced apart linear bearings 24*a* and 24*b* (FIG. 5) are mounted on the bearing block 21 for orientation along the longitudinal axis of the structure 1. The linear bearings 24*a* and 24*b* slidably receive a corresponding pair of linear rails or guides 25*a* and 25*b* that are mounted on the downward-facing surface of the upper housing 22. The upper housing 22 slides back and forth over the bearing block 21 when powered by a lead screw or power screw 26 (FIG. 4) that is driven by a motor 31 by way of gearing, a chain and sprockets, or the like (not shown). The motor 31 is mounted on the bearing block 21 by fasteners such as bolts or other suitable means and is held in place by an upstanding motor cover plate 32. The lead screw 26 is threaded through a nut 33 mounted on a nut carrier 34, which is fastened to the downward-facing surface of the upper housing 22. The motor 31 includes a position sensing device or sensor 27 that is electronically connected with a computer 28. The sensor 27 determines the longitudinal position of the upper housing 22 and converts it to a code, which it transmits to the computer 28. The sensor 27 is preferably a rotary encoder with a home or limit switch 27*a* (FIG. 5) that may be activated by the linear rails 25*a*, 25*b* or any other moving part of the translation compensation subassembly 20. The rotary sensor 27 may be a mechanical, optical, binary encoding, or Gray encoding sensor device, or it may be of any other suitable construction capable of sensing horizontal movement by deriving incremental counts from a rotating shaft, and encoding and transmitting the information to the computer 28. The home switch 27*a* provides a zero or home reference position for measurement.

The longitudinal translation subassembly 20 is operated by actuating the motor 31 to drive the lead screw 26 such as, for example, an Acme thread form, which causes the nut 33 and attached nut carrier 34 to advance along the screw 26, thereby advancing the linear rails 25*a* and 25*b*, along the respective linear bearings 24*a* and 24*b*, and moving the attached upper housing 22 along a longitudinal axis, toward or away from the opposite end of the structure 1 as shown in FIG. 10. The motor 31 may be selectively actuated by an operator by use of a control (not shown) on a controller or control panel 29, or it may be actuated by responsive control instructions transmitted by the computer 28 in accordance with preselected parameters which are compared to data received from sensors detecting movement in various parts of the structure 1, including movement that actuates the home switch 27*a*.

Figure 2:
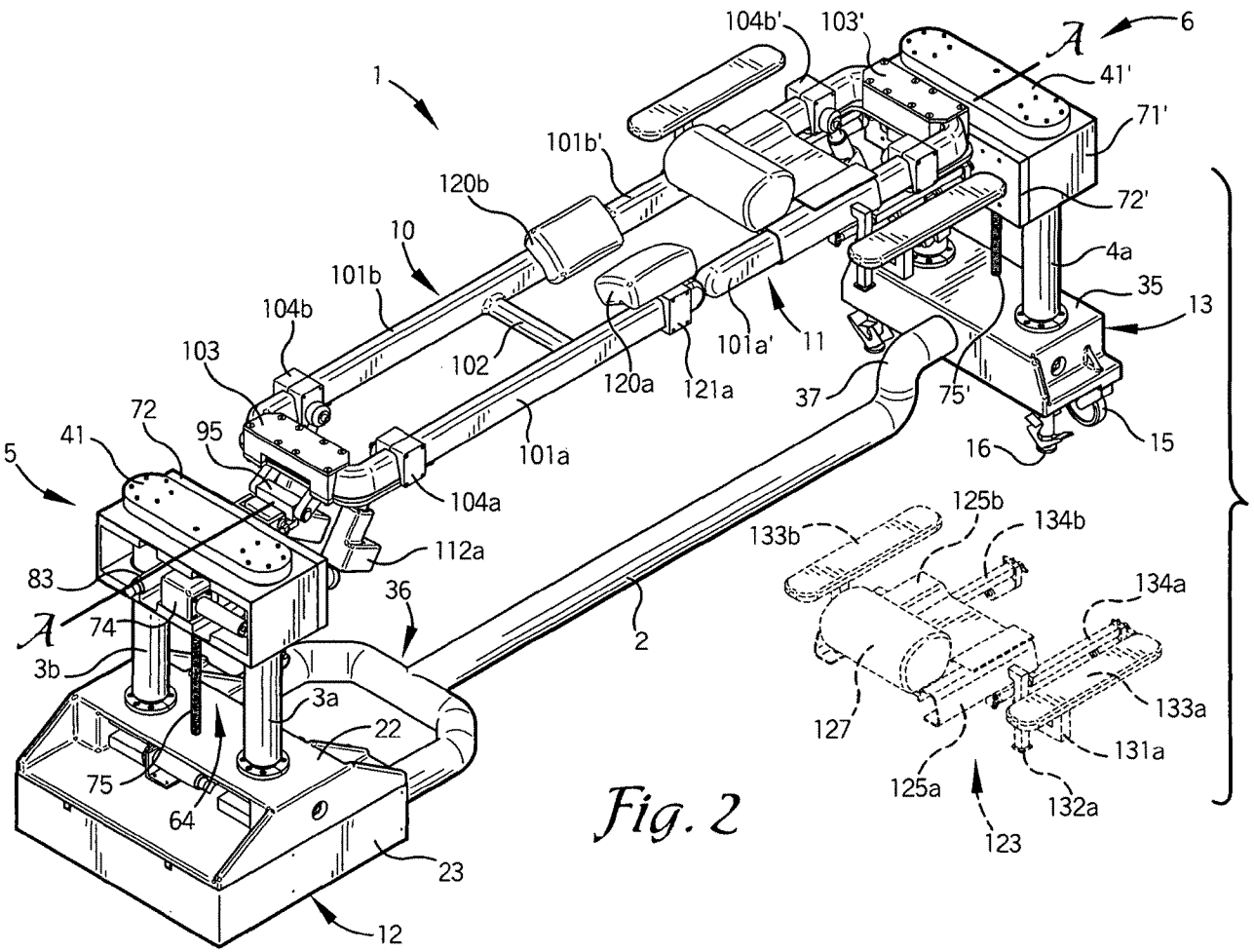
FIG. 2 is a perspective view of the structure of FIG. 1 with the trunk translation assembly shown in phantom in a removed position.

This construction enables the distance between the support column assemblies 3 and 4 (essentially the overall length of the table structure 1) to be shortened from the position shown in FIGS. 1 and 2 in order to maintain the distances D and D' between the inboard ends of the patient supports 10 and 11 when they are positioned, for example, in a planar inclined position as shown in FIG. 9 or in an upwardly (or downwardly) angled or breaking position as shown in FIG. 7 and/or a partially rotated or tilted position also shown in FIG. 7. It also enables the distance between the support column assemblies 3 and 4 to be extended and returned to the original position when the patient supports 10 and 11 are repositioned in a horizontal plane as shown in FIG. 1. Because the upper housing 22 is elevated and slides forwardly and rearwardly over the bearing block 21, it will not run into the feet of the surgical team when the patient supports 10 and 11 are raised and lowered. A second longitudinal translation subassembly 20 may be connected to the second base member 13 to permit movement of both bases 12 and 13 in compensation for angulation of the patient supports 10 and 11. It is also foreseen that the translation assembly may alternatively connected to one or more of the housings 71 and 71' (FIG. 2) of the first and second support assemblies 5 and 6, for positioning closer to the patient support surfaces 10 and 11. It is also foreseen that the rail assembly 2 could be configured as a telescoping mechanism with the longitudinal translation subassembly 20 incorporated therein.

The second base member 13, shown at the head end of the structure 1, includes a housing 37 (FIG. 2) that surmounts the wheels 15 and feet 16. Thus, the top of the housing 37 is generally in a plane with the top of the upper housing 22 of the first base member 12. The connector rail 2 includes a vertically oriented elbow 35 to enable the rail 2 to provide a generally horizontal connection between the first and second bases 12 and 13. The connector rail 2 has a generally Y-shaped overall configuration, with the bifurcated Y or yoke portion 36 adjacent the first base member 12 (FIGS. 2, 7) for receiving portions of the first horizontal support assembly 5 when they are in a lowered position and the upper housing 22 is advanced forwardly, over the rail 2. It is foreseen that the orientation of the first and second base members 12 and 13 may be reversed so that the first base member 12 is located at the head end of the patient support structure 1 and the second base member 13 is located at the foot end.

Figure 5:
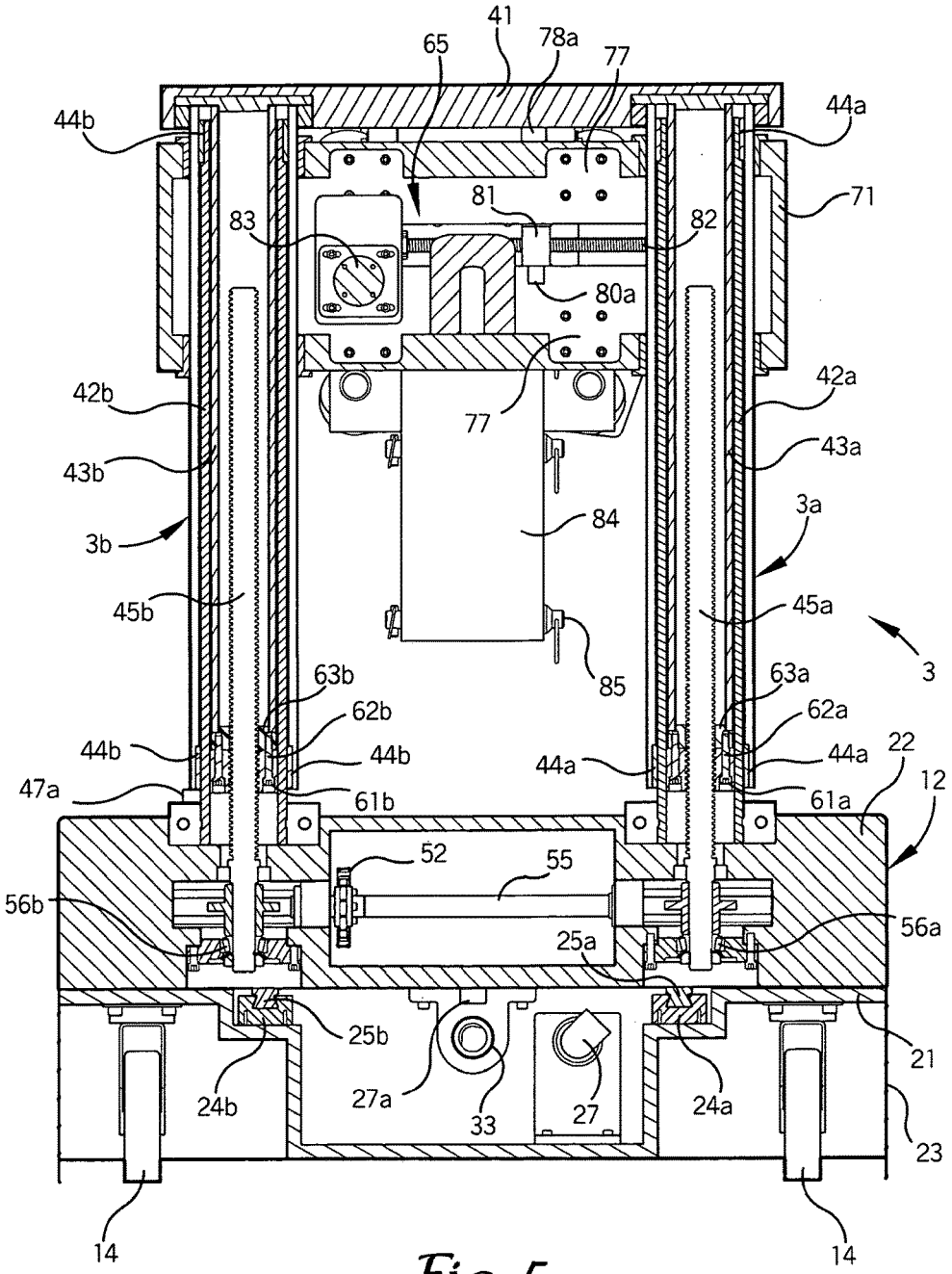
FIG. 5 is a transverse sectional view taken along line 5-5 of FIG. 1.
Figure 6:
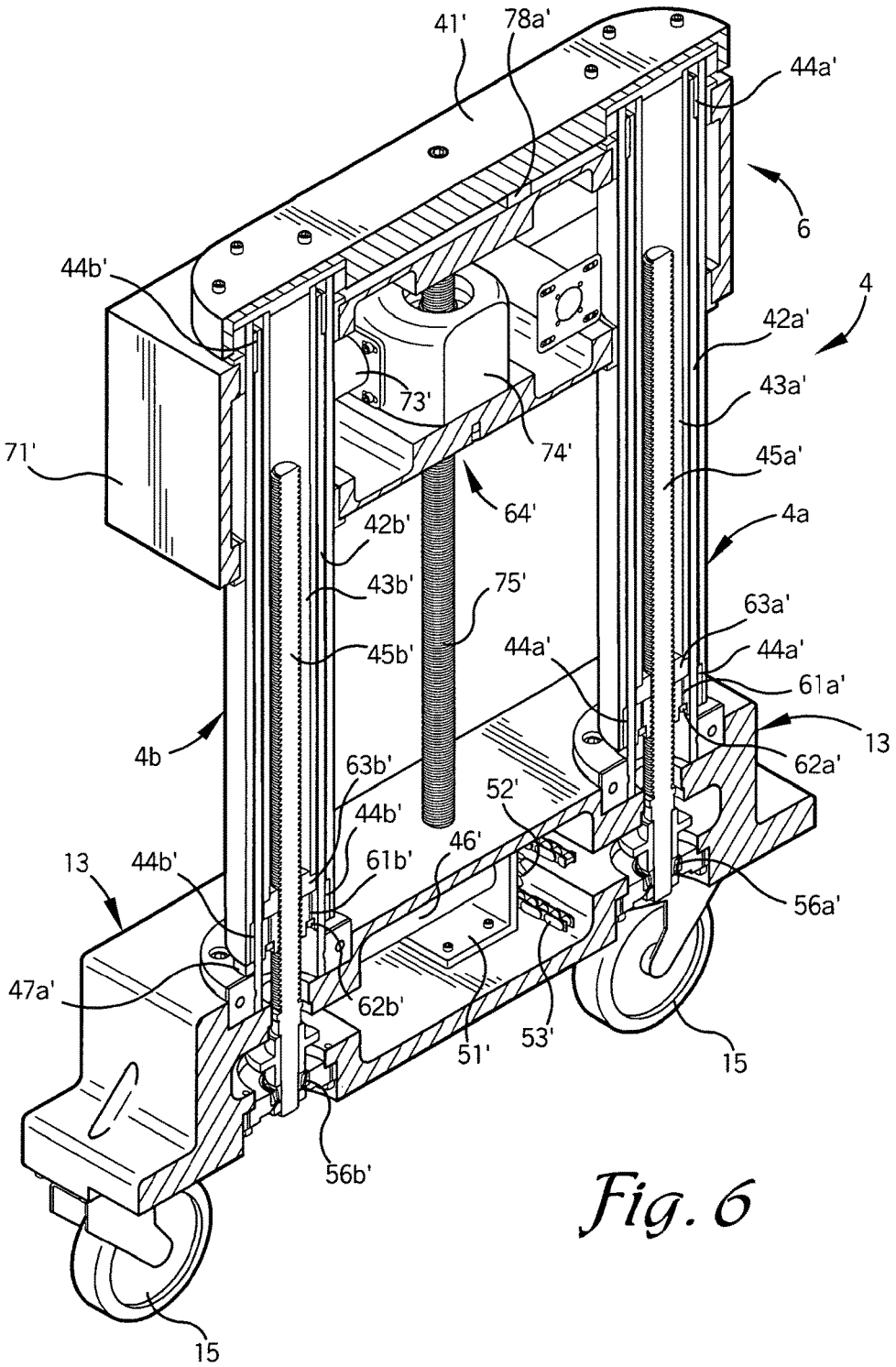
FIG. 6 is a perspective sectional view taken along line 6-6 of FIG. 1.

The first and second base members 12 and 13 are surmounted by respective first and second upright end support or column lift assemblies 3 and 4. The column lift assemblies each include a pair of laterally spaced columns 3*a* and 3*b* or 4*a* and 4*b* (FIGS. 2, 9), each pair surmounted by an end cap 41 or 41'. The columns each include two or more telescoping lift arm segments, an outer segment 42*a* and 42*b* and 42*a*' and 42*b*' and an inner segment 43*a* and 43*b* and 43*a*' and 43*b*' (FIGS. 5 and 6). Bearings 44*a*, 44*b* and 44*a*' and 44*b*' enable sliding movement of the outer portion 42 or 42' over the respective inner portion 43 or 43' when actuated by a lead or power screw 45*a*, 45*b*, 45*a*', or 45*b*' driven by a respective motor 46 (FIG. 4) or 46' (FIG. 6). In this manner, the column assemblies 3 and 4 are raised and lowered by the respective motors 46 and 46'.

The motors 46 and 46' each include a position sensing device or sensor 47, 47' (FIGS. 9 and 11) that determines the vertical position or height of the lift arm segments 42*a,b* and 42*a',b*' and 44*a,b* and 44*a*'b' and converts it to a code, which it transmits to a computer 28. The sensors 47, 47' are preferably rotary encoders with home switches 47*a*, 47*a*' (FIGS. 5 and 6) as previously described.

As best shown in FIG. 4, the motor 46 is mounted to a generally L-shaped bracket 51, which is fastened to the upward-facing surface of the bottom portion of the upper housing 22 by fasteners such as bolts or the like. As shown in FIG. 6, the motor 46' is similarly fastened to a bracket 51', which is fastened to the inner surface of the bottom portion of the second base housing 13. Operation of the motors 46 and 46' drives respective sprockets 52 (FIG. 5) and 52' (FIG. 6). Chains 53 and 53' (FIGS. 4 and 6) are reeved about their respective driven sprockets as well as about respective idler sprockets 54 (FIG. 4) which drive shafts 55 when the motors 46 and 46' are operated. The shafts 55 each drive a worm gear 56*a*, 55*b* and 56*a*', 56*b*' (FIGS. 5, 6), which is connected to a lead screw 45*a* and 45*b* or 45*a*' and 45*b*'. Nuts 61*a*, 61*b* and 61*a*', 61*b*' attach the lead screws 45*a*, 45*b* and 45*a*', 45*b*' to bolts 62*a*, 62*b* and 62*a*', 62*b*', which are fastened to rod end caps 63*a*, 63*b* and 63*a*', 63*b*', which are connected to the inner lift arm segments 43*a*, 43*b* and 43*a*', 43*b*'. In this manner, operation of the motors 46 and 46' drives the lead screws 45*a*, 45*b* and 45*a*', 45*b*', which raise and lower the inner lift arm segments 43*a*, 43*b* and 43*a*', 43*b*' (FIGS. 1, 10) with respect to the outer lift arm segments 42*a*, 42*b*, and 42*a*', 42*b*'.

Figure 8:
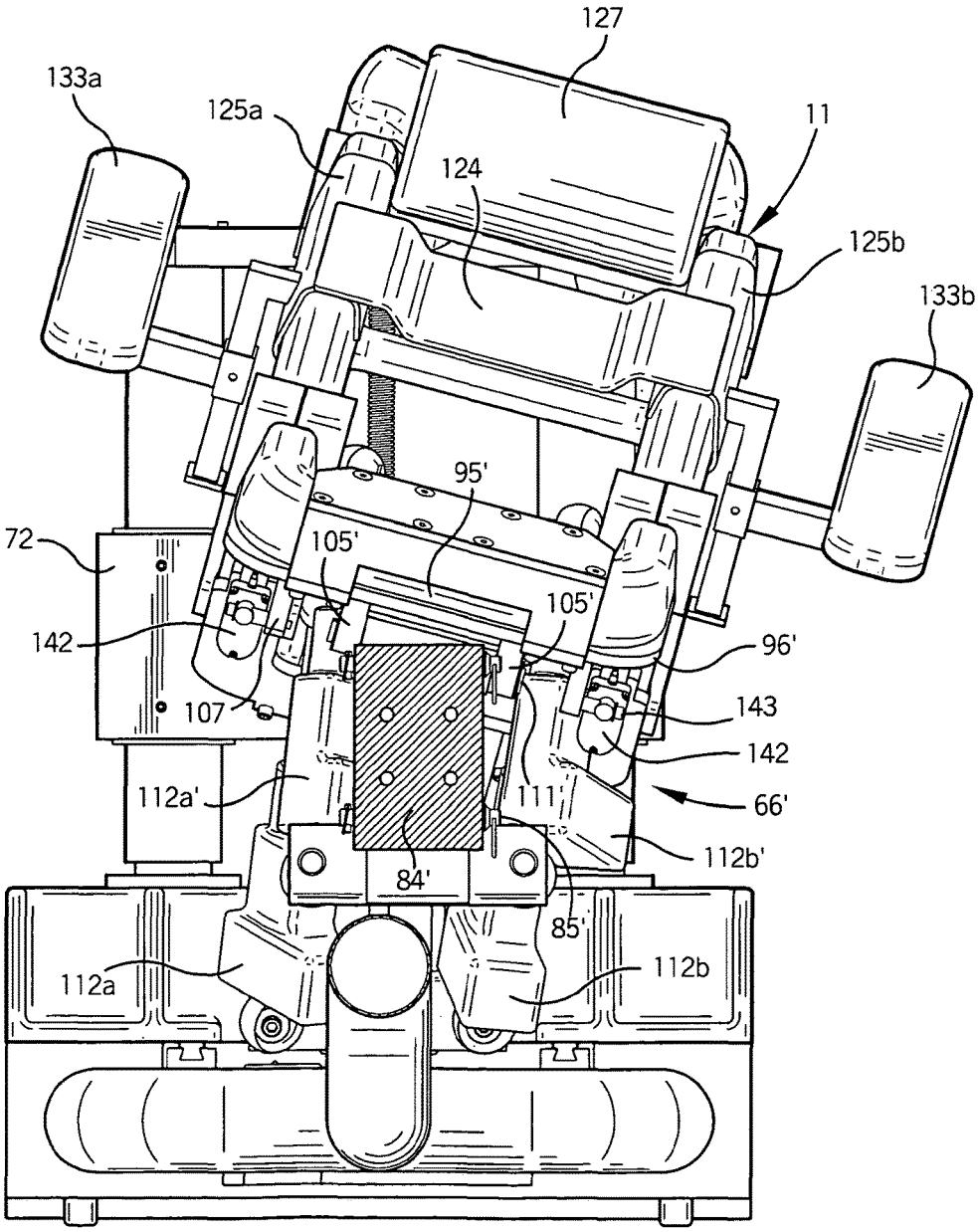
FIG. 8 is an enlarged transverse sectional view taken along line 8-8 of FIG. 7.
Figure 12:
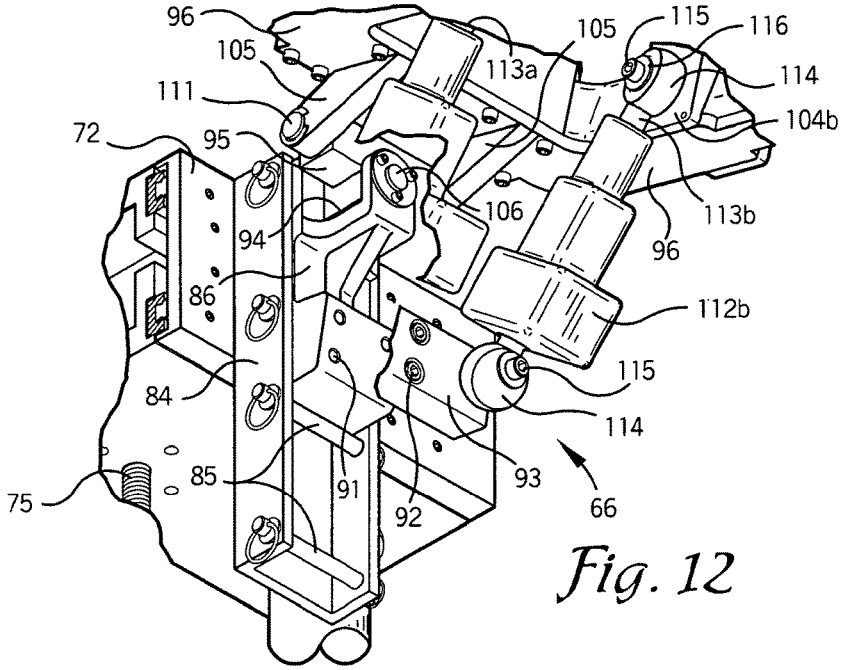
FIG. 12 is an enlarged perspective view of a portion of the structure of FIG. 10, with parts broken away to show details of the angulation/rotation subassembly.

Each of the first and second support assemblies 5 and 6 (FIG. 1) generally includes a secondary vertical lift subassembly 64 and 64' (FIGS. 2 and 6), a lateral or horizontal shift subassembly 65 and 65' (FIGS. 5 and 15), and an angulation/tilt or roll subassembly 66 and 66' (FIGS. 8, 10 and 12). The second support assembly 6 also including a patient trunk translation assembly or trunk translator 123 (FIGS. 2, 3, 13), which are interconnected as described in greater detail below and include associated power source and circuitry linked to a computer 28 and controller 29 (FIG. 1) for coordinated and integrated actuation and operation.

Figure 14:
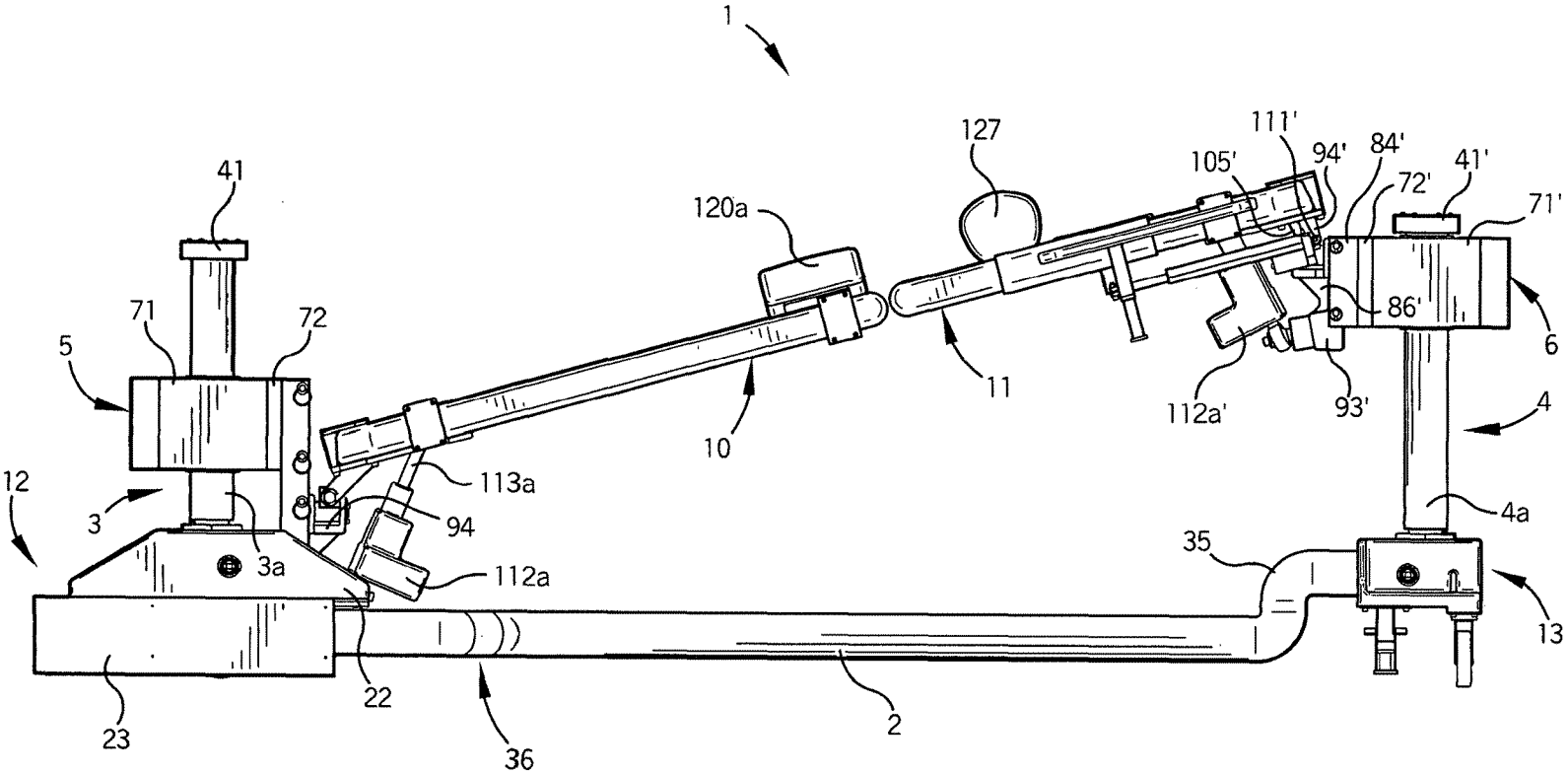
FIG. 14 is a side elevational view of the structure of FIG. 1 shown in an alternate planar inclined position.
Figure 15:
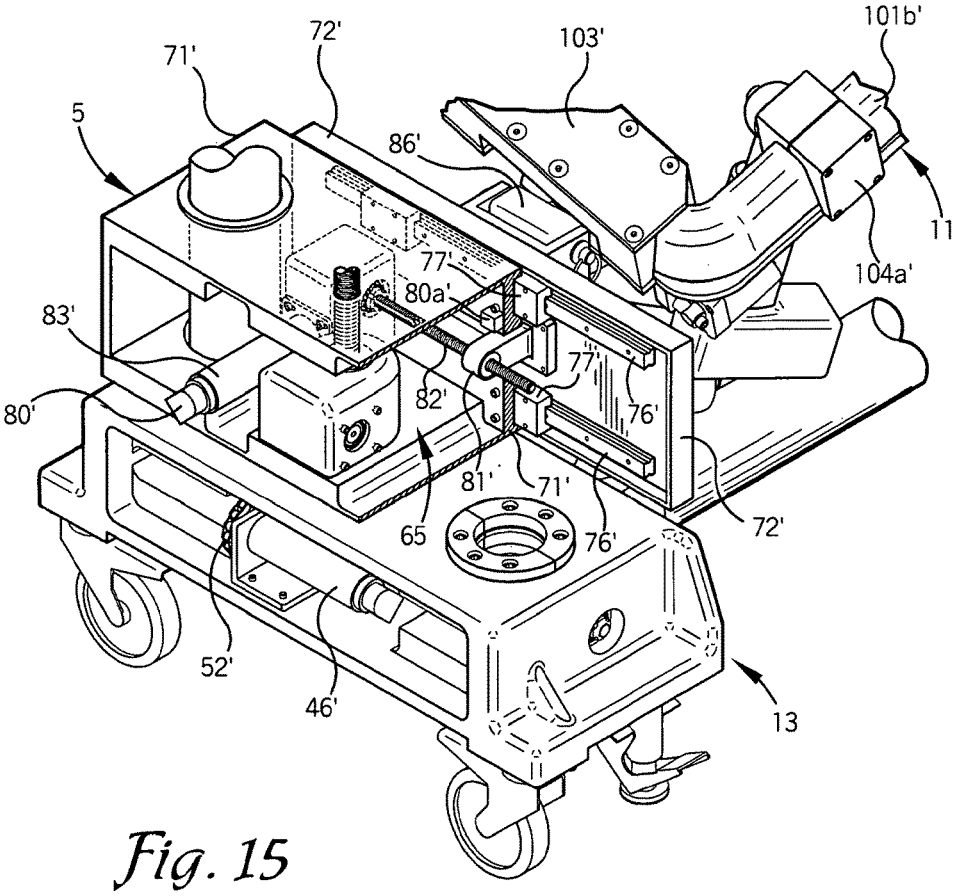
FIG. 15 is an enlarged perspective view of structure of the second end support column, with parts broken away to show details of the horizontal shift subassembly.
Figure 16:
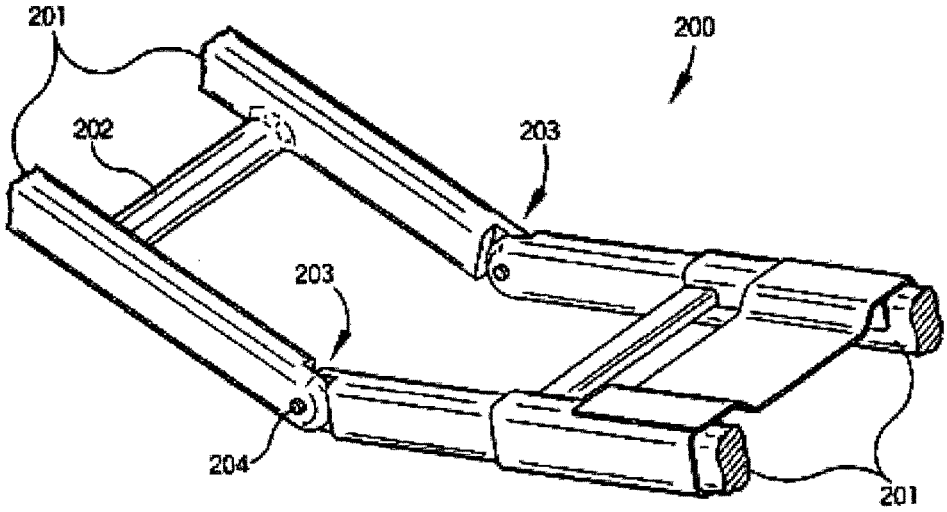
FIG. 16 is an enlarged fragmentary perspective view of an alternate patient positioning support structure incorporating a mechanical articulation of the inboard ends of the patient supports and showing the patient supports in a downward angled position and the trunk translator moved away from the hinge.

The column lift assemblies 3, 4 and secondary vertical lift subassemblies 64 and 64' in cooperation with the angulation and roll or tilt subassemblies 66 and 66' cooperatively enable the selective breaking of the patient supports 10 and 11 at desired height levels and increments as well as selective angulation of the supports 10 and 11 in combination with coordinated roll or tilt of the patient supports 10 and 11 about a longitudinal axis of the structure 1. The lateral or horizontal shift subassemblies 65 and 65' enable selected, coordinated horizontal shifting of the patient supports 10 and 11 along an axis perpendicular to the longitudinal axis of the structure 1, either before or during performance of any of the foregoing maneuvers (FIG. 15). In coordination with the column lift assemblies 3 and 4 and the secondary vertical lift subassemblies 64 and 64', the angulation and roll or tilt subassemblies 66 and 66' enable coordinated selective raising and lowering of the patient supports 10 and 11 to achieve selectively raised and lowered planar horizontal positions (FIGS. 1, 2 and 11), planar inclined positions such as Trendelenburg's position and the reverse (FIGS. 9, 14), angulation of the patient support surfaces in upward (FIG. 7) and downward breaking angles with sideways roll or tilting of the patient support structure 1 about a longitudinal axis of the structure 1 (FIG. 8), all at desired height levels and increments.

During all of the foregoing operations, the longitudinal translation subassembly 20 enables coordinated adjustment of the position of the first base member so as to maintain the distances D and D' between the inboard ends of the patient supports 10 and 11 as the base of the triangle formed by the supports is lengthened or shortened in accordance with the increase or decrease of the angle subtended by the inboard ends of the supports 10 and 11 (FIGS. 7, 9, 10 and 14).

The trunk translation assembly 123 (FIGS. 2, 3, 13) enables coordinated shifting of the patient's upper body along the longitudinal axis of the patient support 11 as required for maintenance of normal spinal biomechanics and avoidance of excessive traction or compression of the spine as the angle subtended by the inboard ends of the supports 10 and 11 is increased or decreased.

The first and second horizontal support assemblies 5 and 6 (FIG. 2) each include a housing 71 and 71' having an overall generally hollow rectangular configuration, with inner structure forming a pair of vertically oriented channels that receive the outer lift arm segments 42A, 42B and 42*a*', 42*b*' (FIGS. 5, 6). The inboard face of each housing 71 and 71' is covered by a carrier plate 72, 72' (FIG. 2). The secondary vertical lift subassemblies 64 and 64' (FIGS. 2, 5 and 6) each include a motor 73 and 73' that drives a worm gear (not shown) housed in a gear box 74 or 74' connected to the upper bottom surface of the housing 71 or 71'. The worm gear drivingly engages a lead or power screw 75 and 75', the uppermost end of which is connected to the lower surface or bottom of the respective end cap 41 and 41'.

The motors 73 and 73' each include a respective position sensing device or height sensor 78, 78' (FIGS. 9 and 11) that determines the vertical position of the respective housing 70 and 71 and converts it to a code, which it transmits to the computer 28. The sensors 78 and 78' are preferably rotary encoders as previously described and cooperate with respective home switches 78*a* and 78*a*' (FIGS. 5 and 6). An example of an alternate height sensing device is described in U.S. Pat. No. 4,777,798, the disclosure of which patent is incorporated by reference. As the motor 73 or 73' rotates the worm gear, it drives the lead screw 75 or 75', thereby causing the housing 71 or 71' to shift upwardly or downwardly over the outer lift arm segments 42 and 42". Selective actuation of the motors 73 and 73' thus enables the respective housings 71 and 71' to ride up and down on the columns 3*a* and 3*b* and 4*a* and 4*b* between the end caps 41 and 41' and base members 12 and 13 (FIGS. 7, 9 and 14). Coordinated actuation of the column motors 46 and 46' with the secondary vertical lift motors 73 and 73' enables the housings 71 and 71' and their respective attached carrier plates 72 and 72', and thus the patient supports 10 and 11, to be raised to a maximum height, or alternatively lowered to a minimum height, as shown in FIGS. 9 and 14.

The lateral or horizontal shift subassemblies 65 and 65', shown in FIGS. 5 and 15, each include a pair of linear rails 76 or 76' mounted on the inboard face of the respective plate 72 or 72'. Corresponding linear bearings 77 and 77' are mounted on the inboard wall of the housing 71 and 71'. A nut carrier 81 or 81' is attached to the back side of each of the plates 72 and 72' in a horizontally threaded orientation for receiving a nut through which passes a lead or power screw 82 or 82' that is driven by a motor 83 or 83'. The motors 83, 83' each include a respective position sensing device or sensor 80, 80' (FIGS. 11 and 15) that determines the lateral movement or shift of the plate 72 or 72' and converts it to a code, which is transmitted to the computer 28. The sensors 80, 80' are preferably rotary encoders as previously described and cooperate with home switches 80*a* and 80*a*' (FIGS. 5 and 15).

Operation of the motors 83 and 83' drives the respective screws 82 and 82', causing the nut carriers to advance along the screws 82 and 82', along with the plates 72 and 72', to which the nut carriers are attached. In this manner, the plates 72 and 72' are shifted laterally with respect to the housings 71 and 71', which are thereby also shifted laterally with respect to a longitudinal axis of the patient support 1. Reversal of the motors 83 and 83' causes the plates 72 and 72' to shift in a reverse lateral direction, enabling horizontal back-and-forth lateral or horizontal movement of the subassemblies 65 and 65'. It is foreseen that a single one of the motors 83 or 83' may be operated to shift a single one of the subassemblies 65 or 65' in a lateral direction.

While a linear rail type lateral shift subassembly has been described, it is foreseen that a worm gear construction may also be used to achieve the same movement of the carrier plates 72 and 72'.

The angulation and tilt or roll subassemblies 66 and 66' shown in FIGS. 8, 10, 12 and 14, each include a generally channel shaped rack 84 and 84' (FIG. 7) that is mounted on the inboard surface of the respective carrier plate 72 or 72' of the horizontal shift subassembly 65 or 65'. The racks 84 and 84' each include a plurality of spaced apart apertures sized to receive a series of vertically spaced apart hitch pins 85 (FIG. 10) and 85' (FIG. 8) that span the racks 84 and 84' in a rung formation. The rack 84' at the head end of the structure 1 is depicted in FIGS. 1 and 7 as being of somewhat shorter length than the rack 84 at the foot end, so that it does not impinge on the elbow 35 when the support assembly 6 is in the lowered position depicted in FIG. 7.

Each of the racks 84 and 84' supports a main block 86 (FIG. 12) or 86' (FIG. 15), which is laterally bored through at the top and bottom to receive a pair of hitch pins 85 or 85'. The blocks 86 and 86' each have an approximately rectangular footprint that is sized for reception within the channel walls of the racks by the pins 85 and 85'. The hitch pins 85 and 85' hold the blocks 86 and 86' in place on the racks, and enable them to be quickly and easily repositioned upwardly or downwardly on the racks 84 and 84' at a variety of heights by removal of the pins 85 and 85', repositioning of the blocks, and reinsertion of the pins at the new locations.

Each of the blocks 86 and 86' includes at its lower end a plurality of apertures 91 for receiving fasteners 92 that connect an actuator mounting plate 93 or 93' to the block 86 or 86' (FIGS. 12 and 14). Each block also includes a channel or joint 94 and 94' which serves as a universal joint for receiving the stem portion of the generally T-shaped yokes 95, 95' (FIGS. 7 and 12). The walls of the channel as well as the stem portion of each of the yokes 95 and 95' are bored through from front to back to receive a pivot pin 106 (FIG. 12) that retains the stem of the yoke in place in the joint 94 or 94' while permitting rotation of the yoke from side to side about the pin. The transverse portion of each of the yokes 95 and 95' is also bored through along the length thereof.

Figure 3:
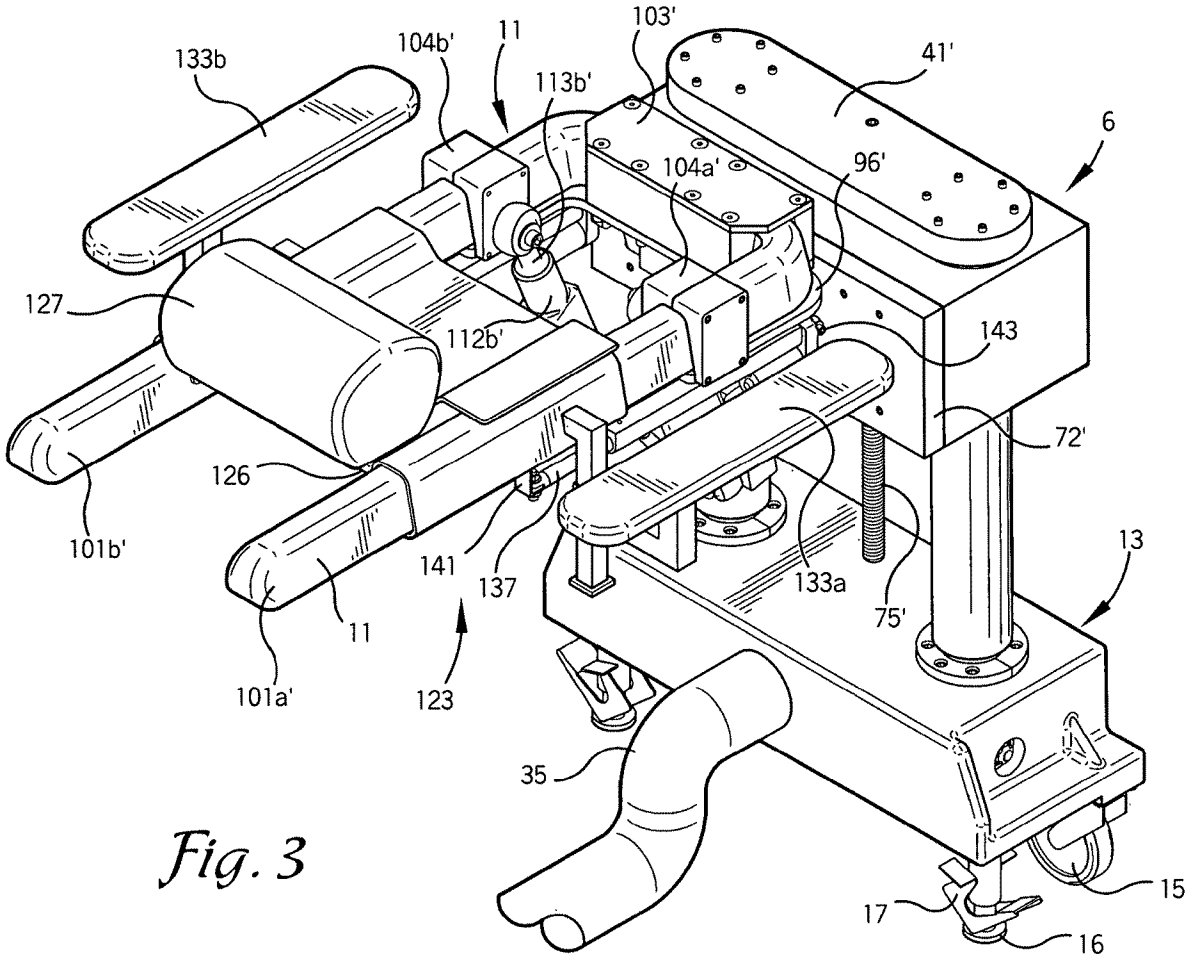
FIG. 3 is an enlarged fragmentary perspective view of one of the support columns with patient support structure of FIG. 1.

Each of the yokes supports a generally U-shaped plate 96 and 96' (FIGS. 12 and 8) that in turn supports a respective one of the first and second patient supports 10 and 11 (FIGS. 3 and 12). The U-shaped bottom plates 96 and 96' each include a pair of spaced apart dependent inboard ears 105 and 105' (FIGS. 8 and 12). The ears are apertured to receive pivot pins 111 and 111' that extend between the respective pairs of ears and through the transverse portion of the yoke to hold the yoke in place in spaced relation to a respective bottom plate 96 or 96'. The bottom plate 96' installed at the head end of the structure 1 further includes a pair of outboard ears 107 (FIG. 9), for mounting the translator assembly 123, as will be discussed in more detail.

The pivot pins 111 and 111' enable the patient supports 10 and 11, which are connected to respective bottom plates 96 and 96', to pivot upwardly and downwardly with respect to the yokes 95 and 95'. In this manner, the angulation and roll or tilt subassemblies 66 and 66' provide a mechanical articulation at the outboard end of each of the patient supports 10 and 11. An additional articulation at the inboard end of each of the patient supports 10 and 11 will be discussed in more detail below.

As shown in FIG. 2, each patient support or frame 10 and 11 is a generally U-shaped open framework with a pair of elongate, generally parallel spaced apart arms or support spars 101*a* and 101*b* and 101*a'* and 101*b'* extending inboard from a curved or bight portion at the outboard end. The patient support framework 10 at the foot end of the structure 1 is illustrated with longer spars than the spars of the framework 11 at the head end of the structure 1, to accommodate the longer lower body of a patient. It is foreseen that all of the spars, and the patient support frameworks 10 and 11 may also be of equal length, or that the spars of framework 11 could be longer than the spars of framework 10, so that the overall length of framework 11 will be greater than that of framework 10. A cross brace 102 may be provided between the longer spars 101*a* and 101*b* at the foot end of the structure 1 to provide additional stability and support. The curved or bight portion of the outboard end of each framework is surmounted by an outboard or rear bracket 103 or 103' which is connected to a respective supporting bottom plate 96 or 96' by means of bolts or other suitable fasteners. Clamp style brackets 104*a* and 104*b* and 104*a'* and 104*b'* also surmount each of the spars 101*a* and 101*b* and 101*a'* and 101*b'* in spaced relation to the rear brackets 103 and 103'. The clamp brackets are also fastened to the respective supporting bottom plates 96 and 96' (FIGS. 1, 10). The inboard surface of each of the brackets 104*a* and 104*b* and 104*a'* and 104*b'* functions as an upper actuator mounting plate (FIG. 3).

The angulation and roll subassemblies 66 and 66' each further include a pair of linear actuators 112*a* and 112*b* and 112*a'* and 112*b'* (FIGS. 8 and 10). Each actuator is connected at one end to a respective actuator mounting plate 93 or 93' and at the other end to the inboard surface of one of the respective clamp brackets 104*a*, 104*b* or 104*a'*, 104*b'*. Each of the linear actuators is interfaced connected with the computer 28. The actuators each include a fixed cover or housing containing a motor (not shown) that actuates a lift arm or rod 113*a* or 113*b* or 113*a'* or 113*b'* (FIGS. 12, 14). The actuators are connected by means of ball-type fittings 114, which are connected with the bottom of each actuator and with the end of each lift arm. The lower ball fittings 114 are each connected to a respective actuator mounting plate 93 or 93', and the uppermost fittings 114 are each connected to the inboard surface of a respective clamp bracket 104*a* or 104*b* or 104*a'* or 104*b'*, all by means of a fastener 115 equipped with a washer 116 (FIG. 12) to form a ball-type joint.

The linear actuators 112*a*, 112*b*, 112*a'*, 112*b'* each include an integral position sensing device (generally designated by a respective actuator reference numeral) that determines the position of the actuator, converts it to a code and transmits the code to the computer 28. Since the linear actuators are connected with the spars 101*a,b* and 101*a,b'* via the brackets 104*a,b* and 104*a',b'*, the computer 28 can use the data to determine the angles of the respective spars. It is foreseen that respective home switches (not shown) as well as the position sensors may be incorporated into the actuator devices.

The angulation and roll mechanisms 66 and 66' are operated by powering the actuators 112*a*, 112*b*, 112*a'* and 112*b'* using a switch or other similar means incorporated in the controller 29 for activation by an operator or by the computer 28. Selective, coordinated operation of the actuators causes the lift arms 113*a* and 113*b* and 113*a'* and 113*b'* to move respective spars 101*a* and 101*b* and 101*a'* and 101*b'*. The lift arms can lift both spars on a patient support 10 or 11 equally so that the ears 105 and 105' pivot about the pins 111 and 111' on the yokes 95 and 95', causing the patient support 10 or 11 to angle upwardly or downwardly with respect to the bases 12 and 13 and connector rail 2. By coordinated operation of the actuators 112*a*, 112*b* and 112*a'*, 112*b'* to extend and/or retract their respective lift arms, it is possible to achieve coordinated angulation of the patient supports 10 and 11 to an upward (FIG. 7) or downward breaking position or to a planar angled position (FIG. 9) or to differentially angle the patient supports 10 and 11 so that each support subtends a different angle, directed either upwardly or downwardly, with the floor surface below. As an exemplary embodiment, the linear actuators 112*a*, 112*b*, 112*a'* and 112*b'* may extend the ends of the spars 101*a*, 101*b*, 101*a'* and 101*b'* to subtend an upward angle of up to about 50.degree. and to subtend a downward angle of up to about 30.degree. from the horizontal.

It is also possible to differentially angle the spars of each support 10 and/or 11, that is to say, to raise or lower spar 101*a* more than spar 101*b* and/or to raise or lower spar 101*a'* more than spare 101*b'*, so that the respective supports 10 and/or 11 may be caused to roll or tilt from side to side with respect to the longitudinal axis of the structure 1 as shown in FIGS. 7 and 8. As an exemplary embodiment, the patient supports may be caused to roll or rotate clockwise about the longitudinal axis up to about 17.degree. from a horizontal plane and counterclockwise about the longitudinal axis up to about 17.degree. from a horizontal plane, thereby imparting to the patient supports 10 and 11 a range of rotation or ability to roll or tilt about the longitudinal axis of up to about 34.degree.

As shown in FIG. 4, the patient support 10 is equipped with a pair of hip or lumbar support pads 120*a*, 120*b* that are selectively positionable for supporting the hips of a patient and are held in place by a pair of clamp style brackets or hip pad mounts 121*a*, 121*b* that surmount the respective spars 101*a*, 101*b* in spaced relation to their outboard ends. Each of the mounts 121*a* and 121*b* is connected to a hip pad plate 122 (FIG. 4) that extends medially at a downward angle. The hip pads 120 are thus supported at an angle that is pitched or directed toward the longitudinal center axis of the supported patient. It is foreseen that the plates could be pivotally adjustable rather than fixed.

The chest, shoulders, arms and head of the patient are supported by a trunk or torso translator assembly 123 (FIGS. 2, 13) that enables translational movement of the head and upper body of the supported patient along the second patient support 11 in both caudad and cephalad directions. The translational movement of the trunk translator 123 is coordinated with the upward and downward angulation of the inboard ends of the patient supports 10 and 11. As best shown in FIG. 2, the translator assembly 123 is of modular construction for convenient removal from the structure 1 and replacement as needed.

Figure 13:
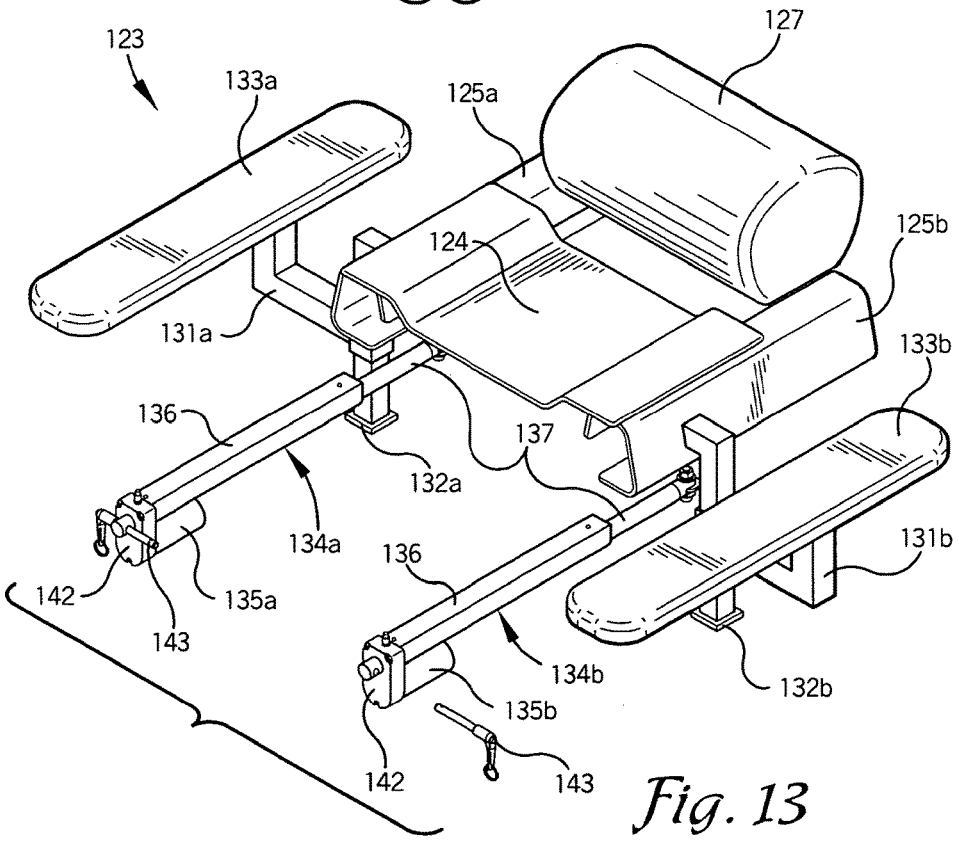
FIG. 13 is an enlarged perspective view of the trunk translator shown disengaged from the structure of FIG. 1.

The translator assembly 123 is constructed as a removable component or module, and is shown in FIG. 13 disengaged and removed from the structure 1 and as viewed from the patient's head end. The translator assembly 123 includes a head support portion or trolley 124 that extends between and is supported by a pair of elongate support or trolley guides 125*a* and 125*b*. Each of the guides is sized and shaped to receive a portion of one of the spars 101*a*' and 101*b*' of the patient support 11. The guides are preferably lubricated on their inner surfaces to facilitate shifting back and forth along the spars. The guides 125*a* and 125*b* are interconnected at their inboard ends by a crossbar, cross brace or rail 126 (FIG. 3), which supports a sternum pad 127. An arm rest support bracket 131*a* or 131*b* is connected to each of the trolley guides 125*a* and 125*b* (FIG. 13). The support brackets have an approximately Y-shaped overall configuration. The downwardly extending end of each leg terminates in an expanded base 132*a* or 132*b*, so that the legs of the two brackets form a stand for supporting the trunk translator assembly 123 when it is removed from the table 1 (FIG. 2). Each of the brackets 131*a* and 131*b* supports a respective arm rest 133*a* or 133*b*. It is foreseen that arm-supporting cradles or slings may be substituted for the arm rests 133*a* and 133*b*.

The trunk translator assembly 123 includes a pair of linear actuators 134*a*, 134*b* (FIG. 13) that each include a motor 135*a* or 135*b*, a housing 136 and an extendable shaft 137. The linear actuators 134*a* and 134*b* each include an integral position sensing device or sensor (generally designated by a respective actuator reference number) that determines the position of the actuator and converts it to a code, which it transmits to the computer 28 as previously described. Since the linear actuators are connected with the trunk translator assembly 123, the computer 28 can use the data to determine the position of the trunk translator assembly 123 with respect to the spars 101*a*' and 101*b*'. It is also foreseen that each of the linear actuators may incorporate an integral home switch (generally designated by a respective actuator reference number).

Each of the trolley guides 125*a* and 125*b* includes a dependent flange 141 (FIG. 3) for connection to the end of the shaft 137. At the opposite end of each linear actuator 134, the motor 135 and housing 136 are connected to a flange 142 (FIG. 13) that includes a post for receiving a hitch pin 143. The hitch pins extend through the posts as well as the outboard ears 107 (FIG. 9) of the bottom plate 96', thereby demountably connecting the linear actuators 134*a* and 234*b* to the bottom plate 96' (FIGS. 8, 9).

The translator assembly 123 is operated by powering the actuators 134*a* and 134*b* via integrated computer software actuation for automatic coordination with the operation of the angulation and roll or tilt subassemblies 66 and 66' as well as the lateral shift subassemblies 66, 66', the column lift assemblies 3, 4, vertical lift subassemblies 64, 64' and longitudinal shift subassembly 20. The assembly 123 may also be operated by a user, by means of a switch or other similar means incorporated in the controller 29.

Positioning of the translator assembly 123 is based on positional data collection by the computer in response to inputs by an operator. The assembly 123 is initially positioned or calibrated within the computer by a coordinated learning process and conventional trigonometric calculations. In this manner, the trunk translator assembly 123 is controlled to travel or move a distance corresponding to the change in overall length of the base of a triangle formed when the inboard ends of the patient supports 10 and 11 are angled upwardly or downwardly. The base of the triangle equals the distance between the outboard ends of the patient supports 10 and 11. It is shortened by the action of the translation subassembly 20 as the inboard ends are angled upwardly and downwardly in order to maintain the inboard ends in proximate relation. The distance of travel of the translation assembly 123 may be calibrated to be identical to the change in distance between the outboard ends of the patient supports, or it may be approximately the same. The positions of the supports 10 and 11 are measured as they are raised and lowered, the assembly 123 is positioned accordingly and the position of the assembly is measured. The data points thus empirically obtained are then programmed into the computer 28. The computer 28 also collects and processes positional data regarding longitudinal translation, height from both the column assemblies 3 and 4 and the secondary lift assemblies 73, 73', lateral shift, and tilt orientation from the sensors 27, 47, 47', 78, 78', 80, 80', and 112*a*, 112*b* and 112*a*', 112*b*'. Once the trunk translator assembly 123 is calibrated using the collected data points, the computer 28 uses these data parameters to processes positional data regarding angular orientation received from the sensors 112*a*, 112*b*, 112*a*', 112*b*' and feedback from the trunk translator sensors 134*a*, 134*b* to determine the coordinated operation of the motors 135*a* and 135*b* of the linear actuators 134*a*, 134*b*.

The actuators drive the trolley guides 125*a* and 125*b* supporting the trolley 124, sternum pad 127 and arm rests 133*a* and 133*b* back and forth along the spars 101*a*' 101*b*' in coordinated movement with the spars 101*a*, 101*b*, 101*a*' and 101*b*'. By coordinated operation of the actuators 134*a* and 134*b* with the angular orientation of the supports 10 and 11, the trolley 124 and associated structures are moved or translated in a caudad direction, traveling along the spars 101*a*' and 101*b*' toward the inboard articulation of the patient support 11, in the direction of the patient's feet when the ends of the spars are raised to an upwardly breaking angle (FIG. 7), thereby avoiding excessive traction on the patient's spine. Conversely, by reverse operation of the actuators 134*a* and 134*b*, the trolley 124 and associated structures are moved or translated in a cephalad direction, traveling along the spars 101*a*', 101*b*' toward the outboard articulation of the patient support 11, in the direction of the patient's head when the ends of the spars are lowered to a downwardly breaking angle, thereby avoiding excessive compression of the patient's spine. It is foreseen that the operation of the actuators may also be coordinated with the tilt orientation of the supports 10 and 11.

Figure 11:
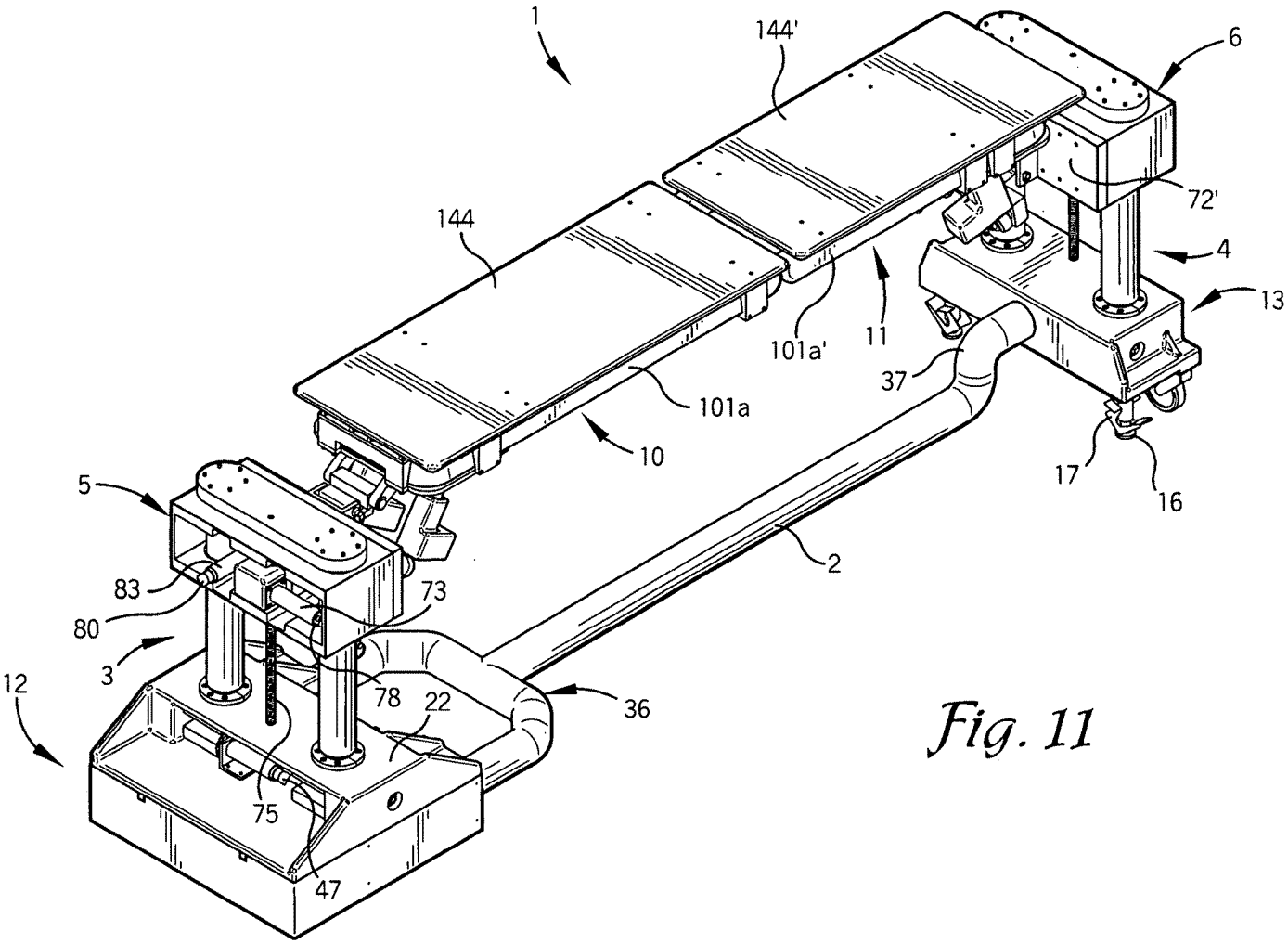
FIG. 11 is a perspective view of the structure of FIG. 1 shown with a pair of planar patient support surfaces replacing the patient supports of FIG. 1.

When not in use, the translator assembly 123 can be easily removed by pulling out the hitch pins 143 and disconnecting the electrical connection (not shown). As shown in FIG. 11, when the translator assembly 123 is removed, planar patient support elements such as imaging tops 144 and 144' may be installed atop the spars 101*a*, 101*b* and 101*a*', 101*b*' respectively. It is foreseen that only one planar element may be mounted atop spars 101*a*, 101*b* or 101*a*', 101*b*', so that a planar support element 144 or 144' may be used in combination with either the hip pads 120*a* and 120*b* or the translator assembly 123. It is also foreseen that the translator assembly support guides 125*a* and 125*b* may be modified for reception of the lateral margins of the planar support 144' to permit use of the translator assembly in association with the planar support 144'. It is also foreseen that the virtual, open or non-joined articulation of the inboard ends of the illustrated patient support spars 101*a,b* and 101*a',b*' or the inboard ends of the planar support elements 144 and 144' without a mechanical connection may alternatively be mechanically articulated by means of a hinge connection or other suitable element.

In use, the trunk translator assembly 123 is preferably installed on the patient supports 10 and 11 by sliding the support guides 125*a* and 125*b* over the ends of the spars 101*a*' and 101*b*' with the sternum pad 127 oriented toward the center of the patient positioning support structure 1 and the arm rests 133*a* and 133*b* extending toward the second support assembly 6. The translator 123 is slid toward the head end until the flanges 142 contact the outboard ears 107 of the bottom plate 96' and their respective apertures are aligned. The hitch pin 143 is inserted into the aligned apertures to secure the translator 123 to the bottom plate 96' which supports the spars 101*a*' and 101*b*' and the electrical connection for the motors 135 is made.

The patient supports 10 and 11 may be positioned in a horizontal or other convenient orientation and height to facilitate transfer of a patient onto the translator assembly 123 and support surface 10. The patient may be positioned, for example, in a generally prone position with the head supported on the trolley 124, and the torso and arms supported on the sternum pad 127 and arm supports 133*a* and 133*b* respectively. A head support pad may also be provided atop the trolley 124 if desired.

The patient may be raised or lowered in a generally horizontal position (FIGS. 1, 2) or in a feet-up or head-up orientation (FIGS. 9, 14) by actuation of the lift arm segments of the column assemblies 3 and 4 and/or the vertical lift subassemblies 64 and/or 64' in the manner previously described. At the same time, either or both of the patient supports 10 and 11 (with attached translator assembly 123) may be independently shifted laterally by actuation of the lateral shift subassemblies 65 and/or 65', either toward or away from the longitudinal side of the structure 1 as illustrated in FIGS. 32 and 33 of Applicant's U.S. Pat. No. 7,343,635, the disclosure of which patent is incorporated herein by reference. Also at the same time, either or both of the patient supports 10 and 11 (with attached translator assembly 123) may be independently rotated by actuation of the angulation and roll or tilt subassembly 66 and/or 66' to roll or tilt from side to side (FIGS. 7, 8 and 15). Simultaneously, either or both of the patient supports 10 and 11 (with attached translator assembly 123) may be independently angled upwardly or downwardly with respect to the base members 12 and 13 and rail 2. It is also foreseen that the patient may be positioned in a 90.degree./90.degree. kneeling prone position as depicted in FIG. 26 of U.S. Pat. No. 7,343,635 by selective actuation of the lift arm segments of the column lift assemblies 3 and 4 and/or the secondary vertical lift subassemblies 64 and/or 64' as previously described.

When the patient supports 10 and 11 are positioned to a lowered, laterally tilted position, with the inboard ends of the patient supports in an upward breaking angled position, as depicted in FIG. 7, causing the spine of the supported patient to flex, the height sensors 47, 47' and 78, 78' and integral position sensors in the linear actuators 112*a*, 112*b* and 112*a*', 112*b*' convey information or data regarding height, tilt orientation and angular orientation to the computer 28 for automatic actuation of the translator assembly 123 to shift the trolley 124 and associated structures from the position depicted in FIG. 1 so that the ends of the support guides 125*a* and 125*b* are slidingly shifted toward the inboard ends of the spars 101*a*' and 101*b*' as shown in FIG. 7. This enables the patient's head, torso and arms to shift in a caudad direction, toward the feet, thereby relieving excessive traction along the spine of the patient. Similarly, when the patient supports 10 and 11 are positioned with the inboard ends in a downward breaking angled position, causing compression of the spine of the patient, the sensors convey data regarding height, tilt, orientation and angular orientation to the computer 28 for shifting of the trolley 124 away from the inboard ends of the spars 101*a*' and 101*b*'. This enables the patient's head, torso and arms to shift in a cephalad direction, toward the head, thereby relieving excessive compression along the spine of the patient.

By coordinating or coupling the movement of the trunk translator assembly 123 with the angulation and tilt of the patient supports 10 and 11, the patient's upper body is able to slide along the patient support 11 to maintain proper spinal biomechanics during a surgical or medical procedure.

The computer 28 also uses the data collected from the position sensing devices 27, 47, 47', 78, 78', 80, 80', 112*a*, 112*b*, 112*a*', 112*b*', and 134*a*, 134*b* as previously described to coordinate the actions of the longitudinal translation subassembly 20. The subassembly 20 adjusts the overall length of the table structure 1 to compensate for the actions of the support column lift assemblies 3 and 4, horizontal support assemblies 5 and 6, secondary vertical lift subassemblies 64 and 64', horizontal shift subassemblies 65 and 65', and angulation and roll or tilt subassemblies 66 and 66'. In this manner the distance D between the ends of the spars 101*a* and 101*a*' and the distance D' between the ends of the spars 101*b* and 101 *b*' may be continuously adjusted during all of the aforementioned raising, lowering, lateral shifting, rolling or tilting and angulation of the patient supports 10 and 11. The distances D and D' may be maintained at preselected or fixed values or they may be repositioned as needed. Thus, the inboard ends of the patient supports 10 and 11 may be maintained in adjacent, closely spaced or other spaced relation or they may be selectively repositioned. It is foreseen that the distance D and the distance D' may be equal or unequal, and that they may be independently variable.

Use of this coordination and cooperation to control the distances D and D' serves to provide a non-joined or mechanically unconnected inboard articulation at the inboard end of each of the patient supports 10 and 11. Unlike the mechanical articulations at the outboard end of each of the patient supports 10 and 11, this inboard articulation of the structure 1 is a virtual articulation that provides a movable pivot axis or joint between the patient supports 10 and 11 that is derived from the coordination and cooperation of the previously described mechanical elements, without an actual mechanical pivot connection or joint between the inboard ends of the patient supports 10 and 11. The ends of the spars 101*a*, 101*b* and 101*a*', 101*b*' thus remain as fee ends, which are not connected by any mechanical element. However, through the cooperation of elements previously described, they are enabled to function as if connected. It is also foreseen that the inboard articulation may be a mechanical articulation such as a hinge.

Such coordination may be by means of operator actuation using the controller 29 in conjunction with integrated computer software actuation, or the computer 28 may automatically coordinate all of these movements in accordance with preprogrammed parameters or values and data received from the position sensors 27, 47, 47', 78, 78', 80, 80', 117*a*, 117*b*, 117*a*', 117*b*', and 138*a*, 138*b*.

A second embodiment of the patient positioning support structure is generally designated by the reference numeral 200, and is depicted in FIGS. 16-20. The structure 200 is substantially similar to the structure 1 shown in FIGS. 1-15 and includes first and second patient supports 205 and 206, each having an inboard end interconnected by a hinge joint 203, including suitable pivot connectors such as the illustrated hinge pins 204. Each of the patient supports 205 and 206 includes a pair of spars 201, and the spars 201 of the second patient support 206 support a patient trunk translation assembly 223.

The trunk translator 223 is engaged with the patient support 206 and is substantially as previously described and shown, except that it is connected to the hinge joint 203 by a linkage 234. The linkage is connected to the hinge joint 203 in such a manner as to position the trunk translator 223 along the patient support 206 in response to relative movement of the patient supports 205 and 206 when the patient supports are positioned in a plurality of angular orientations.

Figure 17:
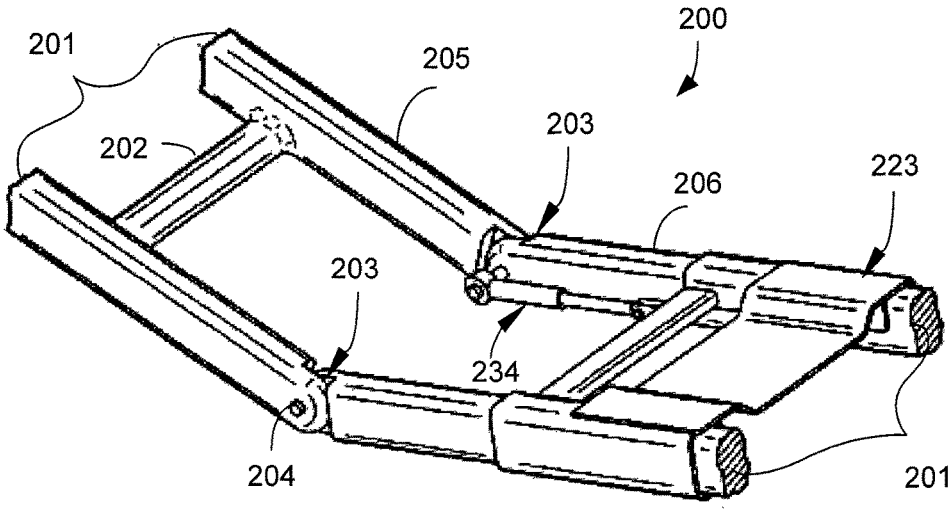
FIG. 17 is a view similar to FIG. 16, showing a linear actuator engaged with the trunk translator to coordinate positioning of the translator with pivoting about the hinge.
Figure 18:
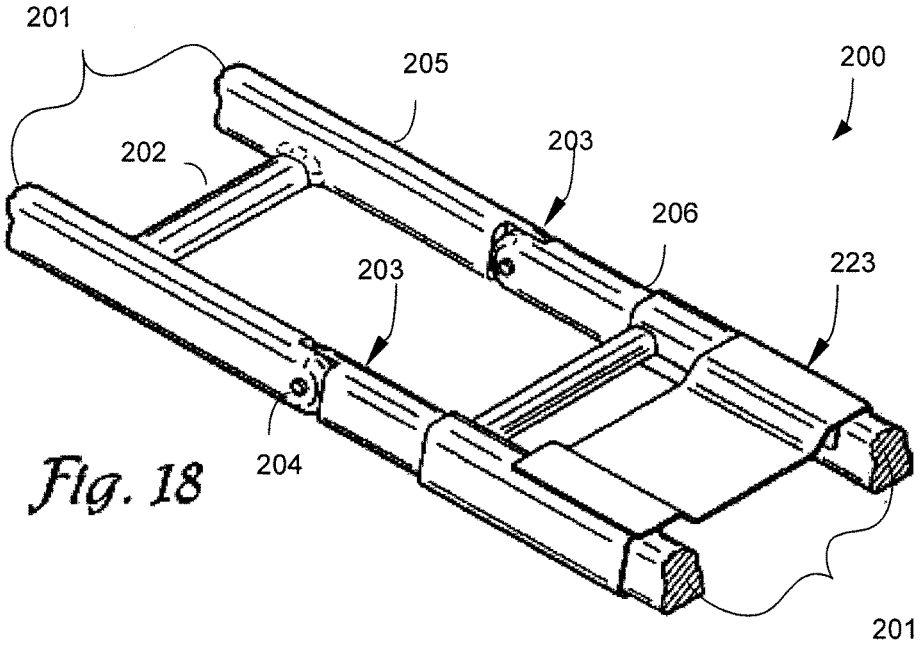
FIG. 18 is a view similar to FIGS. 17 and 18, showing the patient supports in a horizontal position.
Figure 19:
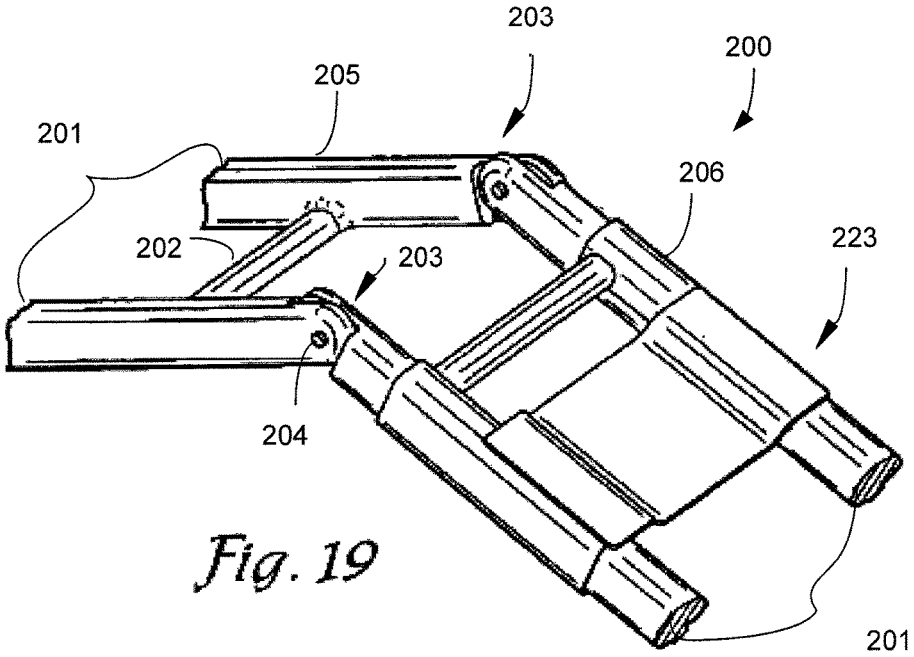
FIG. 19 is a view similar to FIG. 17, showing the patient supports in an upward angled position and the trunk translator moved toward the hinge.
Figure 20:
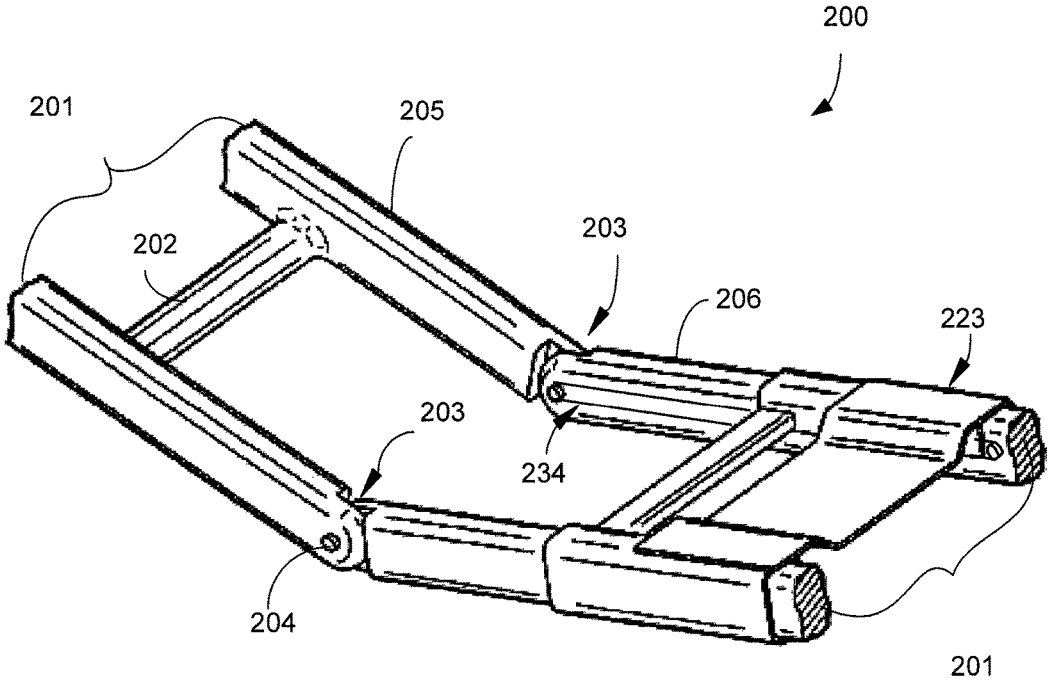
FIG. 20 is a view similar to FIG. 16, showing a cable engaged with the trunk translator to coordinate positioning of the translator with pivoting about the hinge.

In use, the a trunk translator 223 is engaged the patient support 206 and is slidingly shifted toward the hinge joint 203 as shown in FIG. 19 in response to upward angulation of the patient support. This enables the patient's head, torso and arms to shift in a caudad direction, toward the feet. The trunk translator 223 is movable away from the hinge joint 203 as shown in FIG. 17 in response to downward angulation of the patient support 206. This enables the patient's head, torso and arms to shift in a cephalad direction, toward the head.

It is foreseen that the linkage may be a control rod, cable (FIG. 20) or that it may be an actuator 234 as shown in FIG. 17, operable for selective positioning of the trunk translator 223 along the patient support 206. The actuator 234 is interfaced with a computer 28, which receives angular orientation data from sensors as previously described and sends a control signal to the actuator 234 in response to changes in the angular orientation to coordinate a position of the trunk translator with the angular orientation of the patient support 206. Where the linkage is a control rod or cable, the movement of the trunk translator 223 is mechanically coordinated with the angular orientation of the patient support 206 by the rod or cable.

It is to be understood that while certain forms of the patient positioning support structure have been illustrated and described herein, the structure is not to be limited to the specific forms or arrangement of parts described and shown.

The invention claimed is:

1. A patient positioning support structure comprising:

a first column assembly, a second column assembly, and a rail assembly connecting the first column assembly with the second column assembly and comprising a length extending from the first column assembly to the second column assembly;

a patient support comprising a head section and a foot section, the head section comprising a first outer end coupled to the first column assembly and a first inner end, the foot section comprising a second outward end coupled to the second column assembly and a second inner end, the first inner end and the second inner end being non-joined with each other;

a longitudinal translation assembly operably coupled to the second column assembly and configured to move the foot section closer to or farther from the first column assembly while the length of the rail assembly remains constant.

2. The patient positioning support structure of claim 1, wherein the first column assembly surmounts a first base member and the second column assembly surmounts a second base member, the rail assembly having a first end that directly engages the first base member and an opposite second end that directly engages the second base member.

3. A patient positioning support structure for supporting a patient above a floor, the patient positioning support structure comprising:

a first column assembly, a second column assembly spaced-apart from the first column assembly, and a rail assembly coupling the first and second column assembly together and comprising a length;

a patient support structure comprising a head end section and a foot end section, the head end section comprising a first outer end and a second inward end opposite the first outer end, the first outer end operably coupled to the first column assembly in a cantilevered configuration, the foot end section comprising a third outward end and a fourth inward end opposite the third outward end, the third outward end operably coupled to the second column assembly in a cantilevered configuration, the second inward end and the fourth inward end being uncoupled inwardly with each other;

a longitudinal translation assembly operably coupled to the second column assembly and comprising an actuator, wherein, when the actuator is actuated: the fourth inward end of the foot end section is configured to move towards the first column assembly; and the length of the rail assembly remains unchanged;

at least one hip support pad supported on the foot end section; and a chest support assembly comprising a chest pad supported thereon, the chest support assembly supported on the head end section, wherein a chest support actuator is coupled to the chest support assembly and is configured to cause the chest support assembly to translate along the head end section in response to actuation of the chest support actuator.

4. The patient positioning support structure of claim 3, wherein an orientation of the at least one hip support pad and the chest pad is configured to change when the actuator is actuated causing the fourth inward end of the foot end section to move towards the first column assembly.

5. The patient positioning support structure of claim 3, wherein the first and second column assemblies each comprise an upper portion, a lower portion, and at least one actuator configured to raise and lower the upper portion relative to the lower portion.

6. The patient positioning support structure of claim 3, wherein the longitudinal translation assembly supports the second column assembly thereon such that when the actuator is actuated the second column assembly translates towards or away from the first column assembly.

7. The patient positioning support structure of claim 3, wherein at least one first linear actuator is coupled between the first outer end of the head end section and the first column assembly, wherein the at least one first linear actuator is configured to cause the first column assembly to roll about a first roll axis.

8. The patient positioning support structure of claim 7, wherein the at least one first linear actuator comprises two linear actuators.

9. The patient positioning support structure of claim 3, wherein at least one first linear actuator is coupled between the third outward end of the foot end section and the second column assembly, wherein the at least one first linear actuator is configured to cause the second column assembly to roll about a second roll axis.

10. The patient positioning support structure of claim 9, wherein the at least one first linear actuator comprises two linear actuators.

11. A patient positioning support structure for supporting a patient above a floor, the patient positioning support structure comprising:

a first column assembly surmounting a first base member, a second column assembly surmounting a second base member and being spaced-apart from the first column assembly, and a rail assembly coupling the first and second base members together and comprising a length extending between the first and second base members;

a patient support structure comprising a head end section and a foot end section, the head end section comprising a first outer end and a first inner end opposite the first outer end, the first outer end operably coupled to the first column assembly, the foot end section comprising a second outward end and a second inner end opposite the second outward end, the second outward end operably coupled to the second column assembly, the first inner end and the second inner end generally opposing each other and being non-joined with each other;

a longitudinal translation assembly operably coupled to the second column assembly and comprising an actuator, the longitudinal translation assembly configured to move at least a portion of the foot end section closer to or farther from the first column assembly via actuation of the actuator while the length of the rail assembly remains constant.

12. The patient positioning support structure of claim 11, wherein the head end section and foot end section of the patient support structure are configured to be positioned in a plurality of angular orientations relative to each other.

13. The patient positioning support structure of claim 12, wherein the longitudinal translation assembly is configured to actuate the actuator so as to move the at least a portion of the foot end section closer to or farther from the first column assembly when the head end second and foot end section of the patient support structure transition between the plurality of angular orientations.

14. The patient positioning support structure of claim 12, wherein an orientation of the at least one hip support pad and the chest pad is configured to change when the actuator is actuated.

15. The patient positioning support structure of claim 11, wherein the longitudinal translation assembly couples the second column assembly and the second base member together.

16. The patient positioning support structure of claim 11, further comprising at least one hip support pad supported on the foot end section, and a chest support assembly comprising a chest pad supported thereon, the chest support assembly supported on the head end section.

17. The patient positioning support structure of claim 11, wherein the longitudinal translation assembly is configured to move the second inner end of the foot end section closer to the first column assembly via actuation of the actuator.

18. The patient positioning support structure of claim 11, wherein the first and second column assemblies each comprise an upper portion and at least one actuator configured to raise and lower the upper portion relative to the respective first and second base members.

19. The patient positioning support structure of claim 11, wherein the longitudinal translation assembly supports the second column assembly thereon such that when the actuator is actuated the second column assembly translates towards or away from the first column assembly.

20. The patient positioning support structure of claim 11, wherein at least one first linear actuator is coupled between the first outer end of the head end section and the first column assembly, wherein the at least one first linear actuator is configured to cause the first column assembly to roll about a first roll axis.

21. The patient positioning support structure of claim 11, wherein at least one first linear actuator is coupled between the third outward end of the foot end section and the second column assembly, wherein the at least one first linear actuator is configured to cause the second column assembly to roll about a second roll axis.

* * * * *